US011517500B2

(12) United States Patent
Jin et al.

(10) Patent No.: US 11,517,500 B2
(45) Date of Patent: Dec. 6, 2022

(54) MASSAGE APPARATUS

(71) Applicant: LG Electronics Inc., Seoul (KR)

(72) Inventors: Moonsub Jin, Seoul (KR); Beomoh Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 305 days.

(21) Appl. No.: 16/490,524

(22) PCT Filed: Jun. 12, 2019

(86) PCT No.: PCT/KR2019/007053

§ 371 (c)(1),
(2) Date: Aug. 30, 2019

(87) PCT Pub. No.: WO2020/251073

PCT Pub. Date: Dec. 17, 2020

(65) Prior Publication Data

US 2021/0346237 A1 Nov. 11, 2021

(51) Int. Cl.
*A61H 23/02* (2006.01)

(52) U.S. Cl.
CPC . *A61H 23/0254* (2013.01); *A61H 2201/1671* (2013.01); *A61H 2201/5007* (2013.01); *A61H 2201/5046* (2013.01); *A61H 2201/5048* (2013.01); *A61H 2201/5097* (2013.01); *A61H 2203/0431* (2013.01); *A61H 2205/02* (2013.01); *A61H 2205/062* (2013.01); *A61H 2205/081* (2013.01); *A61H 2205/086* (2013.01); *A61H 2205/10* (2013.01)

(58) Field of Classification Search
CPC ..... G16H 20/32; A61H 2201/50–5015
See application file for complete search history.

(56) References Cited

U.S. PATENT DOCUMENTS

| | | | | |
|---|---|---|---|---|
| 5,188,096 | A * | 2/1993 | Yoo | A61H 23/0263 601/57 |
| 2007/0276448 | A1* | 11/2007 | Fairbank | A61H 23/0263 607/46 |
| 2014/0337033 | A1* | 11/2014 | Kim | G06F 3/04883 704/260 |
| 2016/0030281 | A1* | 2/2016 | Shafieloo | A61H 23/0245 601/48 |
| 2017/0348184 | A1* | 12/2017 | Pisharodi | A61F 7/007 |
| 2018/0104135 | A1* | 4/2018 | Lem | B60N 2/976 |
| 2018/0243163 | A1* | 8/2018 | Choudhury | A61H 19/30 |
| 2020/0293111 | A1* | 9/2020 | Gwak | G06F 3/016 |

FOREIGN PATENT DOCUMENTS

| | | |
|---|---|---|
| JP | 2007502179 | 2/2007 |
| KR | 1020080011360 | 2/2008 |
| KR | 1020080099738 | 11/2008 |
| KR | 101177533 | 8/2012 |
| KR | 1020180023370 | 3/2018 |

* cited by examiner

*Primary Examiner* — Valerie L Woodward
*Assistant Examiner* — Paige Kathleen Bugg
(74) *Attorney, Agent, or Firm* — Fish & Richardson P.C.

(57) ABSTRACT

Disclosed is a massage apparatus. The massage apparatus includes a vibration array including a plurality of vibration devices, a driver configured to vibrate the plurality of vibration devices, and a processor configured to control the driver to generate a stimulus at a stimulus point between the plurality of vibration devices by simultaneously vibrating two or more vibration devices among the plurality of vibration devices.

12 Claims, 10 Drawing Sheets

MASSAGE APPARATUS

CROSS-REFERENCE TO RELATED APPLICATIONS

This Application is the National Stage filing under 35 U.S.C. 371 of International Application No. PCT/KR2019/007053, filed on Jun. 12, 2019, the contents of which are incorporated by reference.

TECHNICAL FIELD

The present invention relates to a massage apparatus including a plurality of vibration devices disposed thereon and configured to generate a stimulus at a point where a vibration device is not disposed, using the plurality of vibration devices.

BACKGROUND ART

Recently, apparatuses for maintaining or enhancing the health and physical strength of users or for fatigue recovery and stress reduction in the home, a gym, or the like, for example, a sporting apparatus such as a running machine or a massage apparatus have been developed and has been widely used in real life.

In particular, there has been a high demand for flexing the cramped muscle or overcoming fatigue and stress through massage, and thus a massage apparatus has attracted increasing attention. Massage is one of medical adjuvant therapies of helping blood circulation or fatigue recovery by sweeping, touching, pushing, pulling, tapping, or moving the body using hands or a specific apparatus. An apparatus for performing massage using a mechanical device is a massage apparatus, and a representative example of the massage apparatus is a massage chair for getting massage while a user comfortably sits thereon.

A current massage chair includes a stimulus device such as a roller, a massage stick, or an airbag, and performs massage by applying a stimulus to the human body via an operation of the stimulus device.

However, these stimulus devices are disposed at fixed positions of the massage chair, and thus there is a problem in that a user is not capable of accurately applying a stimulus to a desired part.

In addition, even if it is possible to move the stimulus device, there is a problem in that a limitation in a mechanical design, an increase in costs, or the like is caused in order to move the device itself.

DISCLOSURE

Technical Problem

An object of the present invention devised to solve the problem lies in a massage apparatus including a plurality of vibration devices and configured to generate a stimulus at a point in which a vibration device is not disposed using the plurality of vibration devices.

Technical Solution

In an aspect of the present invention, a massage apparatus includes a vibration array including a plurality of vibration devices, a driver configured to vibrate the plurality of vibration devices, and a processor configured to control the driver to generate a stimulus at a stimulus point between the plurality of vibration devices by simultaneously vibrating two or more vibration devices among the plurality of vibration devices.

Advantageous Effects

According to the present invention, a stimulus may be generated at a point between vibration devices, and thus a part that is desired to be massaged by a user may be advantageously and accurately stimulated.

According to the present invention, various stimulus points may be formed without movement of a stimulus device, and thus the overcome in terms of mechanical design limitations and an increase in manufacturing costs may be advantageously overcome.

According to the present invention, vibration intensity of a vibration device or a vibrating vibration device may be changed, and thus a point in which a stimulus is generated may be smoothly moved.

According to the present invention, the user may advantageously and accurately stimulate a part that is desired to be massaged by the user by simply touching a screen of the mobile terminal.

According to the present invention, it may be advantageous that the user sets a moving path for smoothly moving a point, in which a stimulus is generated, using touch input through the window of the mobile terminal and that the massage chair smoothly moves the point in which the stimulus is generated according to path setting of the user.

In addition, according to the present invention, the user may also advantageously and simply set moving speed of the stimulus point by adjustment of drag speed.

BEST MODE

Figure 1:
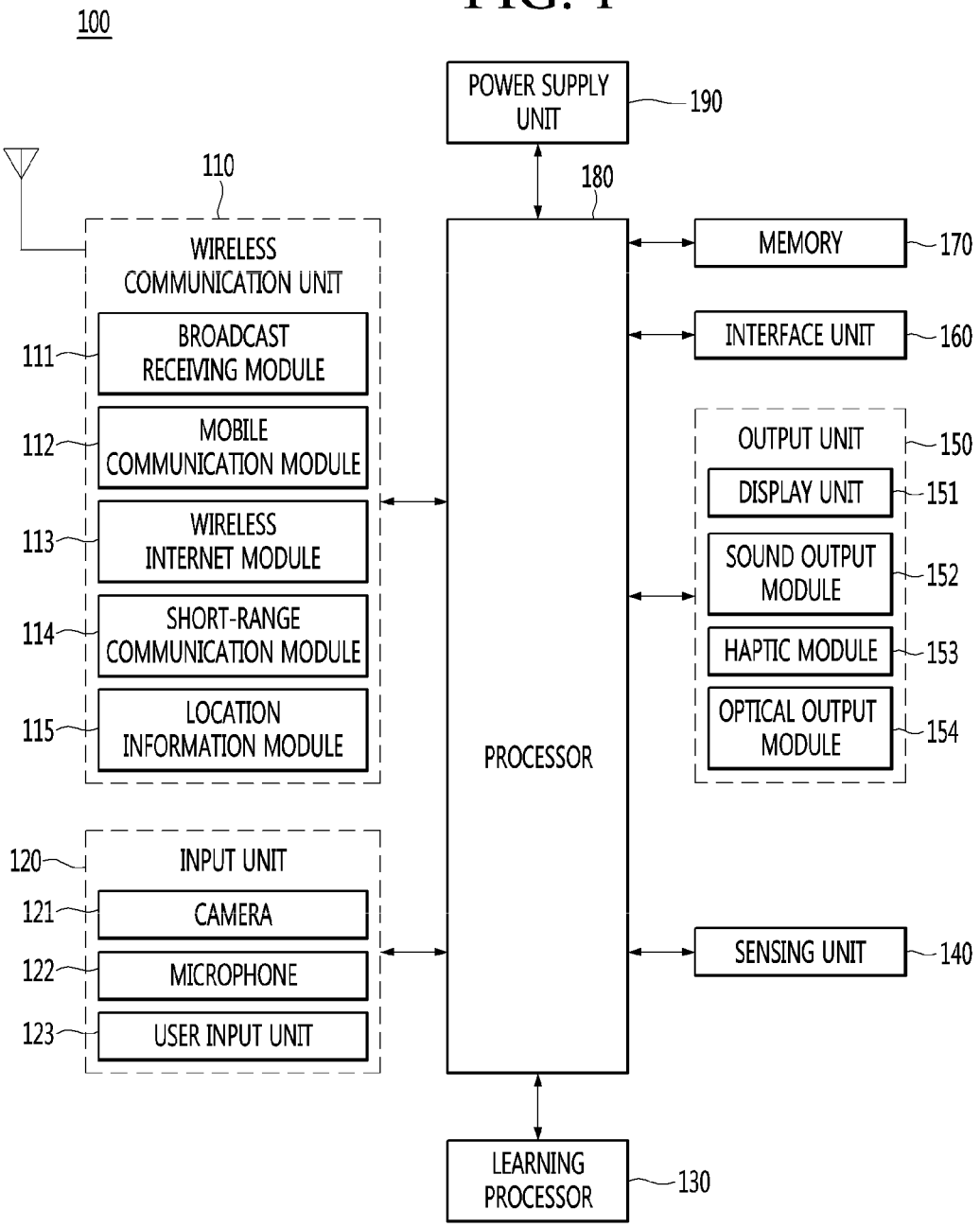
FIG. 1 is a block diagram illustrating a configuration of a terminal 100 according to an embodiment of the present invention.

Hereinafter, embodiments of the present disclosure are described in more detail with reference to accompanying drawings and regardless of the drawings symbols, same or similar components are assigned with the same reference numerals and thus overlapping descriptions for those are omitted. The suffixes "module" and "unit" for components used in the description below are assigned or mixed in consideration of easiness in writing the specification and do not have distinctive meanings or roles by themselves. In the following description, detailed descriptions of well-known functions or constructions will be omitted since they would obscure the invention in unnecessary detail. Additionally, the accompanying drawings are used to help easily understanding embodiments disclosed herein but the technical idea of the present disclosure is not limited thereto. It should be understood that all of variations, equivalents or substitutes contained in the concept and technical scope of the present disclosure are also included.

It will be understood that the terms "first" and "second" are used herein to describe various components but these components should not be limited by these terms. These terms are used only to distinguish one component from other components.

In this disclosure below, when one part (or element, device, etc.) is referred to as being 'connected' to another part (or element, device, etc.), it should be understood that the former can be 'directly connected' to the latter, or 'electrically connected' to the latter via an intervening part (or element, device, etc.). It will be further understood that when one component is referred to as being 'directly connected' or 'directly linked' to another component, it means that no intervening component is present.

The singular expressions in the present specification include the plural expressions unless clearly specified otherwise in context. Also, the terms such as "include" or "comprise" may be construed to denote a certain characteristic, number, step, operation, constituent element, or a combination thereof, but may not be construed to exclude the existence of or a possibility of addition of one or more other characteristics, numbers, steps, operations, constituent elements, or combinations thereof.

In embodiments of the present invention, components may be subdivided for convenience of description, but these components may be embodied in one apparatus or module or one component may be divided and embodied in a plurality of apparatuses or modules.

Hereinafter, embodiments of the present disclosure are described in more detail with reference to accompanying drawings and regardless of the drawings symbols, same or similar components are assigned with the same reference numerals and thus overlapping descriptions for those are omitted. The suffixes "module" and "unit" for components used in the description below are assigned or mixed in consideration of easiness in writing the specification and do not have distinctive meanings or roles by themselves. In the following description, detailed descriptions of well-known functions or constructions will be omitted since they would obscure the invention in unnecessary detail. Additionally, the accompanying drawings are used to help easily understanding embodiments disclosed herein but the technical idea of the present disclosure is not limited thereto. It should be understood that all of variations, equivalents or substitutes contained in the concept and technical scope of the present disclosure are also included.

It will be understood that the terms "first" and "second" are used herein to describe various components but these components should not be limited by these terms. These terms are used only to distinguish one component from other components.

In this disclosure below, when one part (or element, device, etc.) is referred to as being 'connected' to another part (or element, device, etc.), it should be understood that the former can be 'directly connected' to the latter, or 'electrically connected' to the latter via an intervening part (or element, device, etc.). It will be further understood that when one component is referred to as being 'directly connected' or 'directly linked' to another component, it means that no intervening component is present.

Hereinafter, a massage apparatus will be described with regard to a massage chair as an example. However, the present invention is not limited thereto and may be applied to a massage apparatus including a vibration array including a plurality of vibration devices.

FIG. 1 is a block diagram illustrating a configuration of a terminal 100 according to an embodiment of the present invention.

The terminal 100 may be embodied as a fixed type device, a mobile device, or the like, which includes a mobile phone, a projector, a mobile phone, a smart phone, a laptop computer, a digital broadcast terminal, a personal digital assistants (PDA), a portable multimedia player (PMP), a navigation device, a slate personal computer (PC), a tablet PC, an ultrabook, a wearable device (e.g., a smartwatch, a smart glass, or a head mounted display (HMD)), a set top box (STB), a DMB receiver, a radio, a washing machine, a refrigerator, an air conditioner, a desk top computer, and a digital signage.

That is, the terminal 100 may be embodied in the form of various home appliances used in the home and may also be applied to a fixed or mobile robot.

The terminal 100 may perform a function of a speech agent. The speech agent may be a program that recognizes user voice and outputs appropriate for the recognized voice in the form of voice.

Referring to FIG. 1, the terminal 100 may include a wireless communication unit 110, an input unit 120, a learning processor 130, a sensing unit 140, an output unit 150, an interface unit 160, a memory 170, a processor 180, and a power supply unit 190.

A trained model may be installed in the terminal 100.

The trained model may be embodied in hardware, software, or a combination of hardware and software, and when an entire or partial portion of the trained model is embodied in software, one or more commands for configuring the trained model may be stored in the memory 170.

The wireless communication unit 110 may include at least one of a broadcast receiving module 111, a mobile communication module 112, a wireless Internet module 113, a short-range communication module 114, or a location information module 115.

The broadcast receiving module 111 of the wireless communication unit 110 may receive a broadcast signal and/or broadcast related information from an external broadcast management terminal through a broadcast channel.

The mobile communication module 112 may transmit/receive a wireless signal to/from at least one of a base station, an external terminal, or a terminal on a mobile communication network established according to the technical standards or communication methods for mobile communication (for example, Global System for Mobile communication (GSM), Code Division Multi Access (CDMA), Code Division Multi Access 2000 (CDMA2000), Enhanced Voice-Data Optimized or Enhanced Voice-Data Only (EV-DO), Wideband CDMA (WCDMA), High Speed Downlink Packet Access (HSDPA), High Speed Uplink Packet Access (HSUPA), Long Term Evolution (LTE), and Long Term Evolution-Advanced (LTE-A)).

The wireless Internet module 113 refers to a module for wireless internet access and may be built in or external to the mobile terminal 100. The wireless Internet module 113 may be configured to transmit/receive a wireless signal in a communication network according to wireless internet technologies.

The wireless internet technology may include Wireless LAN (WLAN), Wireless-Fidelity (Wi-Fi), Wi-Fi Direct, Digital Living Network Alliance (DLNA), Wireless Broadband (WiBro), World Interoperability for Microwave Access (WiMAX), High Speed Downlink Packet Access (HSDPA), High Speed Uplink Packet Access (HSUPA), Long Term Evolution (LTE), and Long Term Evolution-Advanced (LTE-A) and the wireless internet module 113 transmits/receives data according at least one wireless internet technology including internet technology not listed above.

The short-range communication module 114 may support short-range communication by using at least one of Bluetooth™, Radio Frequency Identification (RFID), Infrared Data Association (IrDA), Ultra Wideband (UWB), ZigBee, Near Field Communication (NFC), Wireless-Fidelity (Wi-Fi), Wi-Fi Direct, or Wireless Universal Serial Bus (USB) technologies.

The location information module 115 is a module for obtaining the location (or the current location) of a mobile terminal and its representative examples include a global positioning system (GPS) module or a Wi-Fi module. For example, the mobile terminal may obtain its position by using a signal transmitted from a GPS satellite through the GPS module.

The input unit 120 may include a camera 121 for image signal input, a microphone 122 for receiving audio signal input, and a user input unit 123 for receiving information from a user.

Voice data or image data collected by the input unit 120 are analyzed and processed as a user's control command.

The input unit 120 may acquire input data to be used to acquire output using the trained data and trained model for model learning.

The input unit 120 may acquire input data that is not processed, in which case the processor 180 or the learning processor 130 may pre-process the acquired data and may generate the trained data to be input to the model learning or the pre-processed input data.

In this case, pre-processing of the input data may refer to extraction of an input feature from the input data.

Then, the input unit 120 is used for inputting image information (or signal), audio information (or signal), data, or information inputted from a user and the mobile terminal 100 may include at least one camera 121 in order for inputting image information.

The camera 121 processes image frames such as a still image or a video obtained by an image sensor in a video call mode or a capturing mode. The processed image frame may be displayed on the display unit 151 or stored in the memory 170.

The microphone 122 processes external sound signals as electrical voice data. The processed voice data may be utilized variously according to a function (or an application program being executed) being performed in the mobile terminal 100. Moreover, various noise canceling algorithms for removing noise occurring during the reception of external sound signals may be implemented in the microphone 122.

The user input unit 123 is to receive information from a user and when information is inputted through the user input unit 123, the processor 180 may control an operation of the mobile terminal 100 to correspond to the inputted information.

The user input unit 123 may include a mechanical input means (or a mechanical key, for example, a button, a dome switch, a jog wheel, and a jog switch at the front, back or side of the mobile terminal 100) and a touch type input means. As one example, a touch type input means may include a virtual key, a soft key, or a visual key, which is displayed on a touch screen through software processing or may include a touch key disposed at a portion other than the touch screen.

The learning processor 130 may learn a model configured by an artificial neural network using the trained data.

In detail, the learning processor 130 may repeatedly learn the artificial neural network using the aforementioned various learning schemes, and thus may determine optimized model parameters of the artificial neural network.

In the specification, the artificial neural network, a parameter of which is determined via learning using the trained data, may be referred to as a trained model or a trained model.

In this case, the trained model may be used to infer a result value with respect to new input data, but not the trained data.

The learning processor 130 may be configured to receive, classify, store, and output information which is to be used for data mining, data analysis, intelligent decision, and machine learning algorithms.

The learning processor 130 may include one or more memory units which are configured to store data received, detected, sensed, generated, pre-defined, or outputted by another component, another device, another terminal, or an apparatus communicating with the terminal.

The learning processor 130 may include a memory which is integrated into or implemented in a terminal. In some embodiments, the learning processor 130 may be implemented with the memory 170.

Optionally or additionally, the learning processor 130 may be implemented with a memory associated with a terminal like an external memory directly coupled to the terminal or a memory which is maintained in a terminal communicating with the terminal.

In another embodiment, the learning processor 130 may be implemented with a memory maintained in a cloud computing environment or another remote memory position accessible by a terminal through a communication manner such as a network.

The learning processor 130 may be configured to store data in one or more databases, for supervised or unsupervised learning, data mining, prediction analysis, or identifying, indexing, categorizing, manipulating, storing, searching for, and outputting data to be used in another machine. Here, the database may be embodied using positions of the memory 170, a memory of a learning device, a memory sustained in a cloud computing environment, or other remote memory to be accessed by a terminal through a communication method such as a network.

Information stored in the learning processor 130 may be used by the processor 180 or one or more other controllers of a terminal by using at least one of various different types of data analysis algorithm or machine learning algorithm.

Examples of such algorithms may include a k-nearest neighbor system, a purge logic (for example, possibility theory), a neural network, Boltzmann machine, vector quantization, a pulse neural network, a support vector machine, a maximum margin classifier, hill climbing, an induction logic system Bayesian network, perrytnet (for example, a finite state machine, a milli machine, and a moor finite state machine), a classifier tree (for example, a perceptron tree, a support vector tree, a Markov tree, a decision tree forest, and an arbitrary forest), a reading model and system, artificial mergence, sensor mergence, image mergence, reinforcement mergence, augment reality, pattern recognition, and automated plan.

The processor 180 may determine or predict at least one executable operation of a terminal, based on information determined or generated by using a data analysis algorithm and a machine learning algorithm. To this end, the processor 180 may request, search for, receive, or use data of the learning processor 130 and may control the terminal to execute a predicted operation or a preferably determined operation of the at least one executable operation.

The processor 180 may perform various functions of implementing an intelligent emulation (i.e., a knowledge-based system, an inference system, and a knowledge acquisition system). The processor 180 may be applied to various types of systems (for example, a purge logic system) including an adaptive system, a machine learning system, and an ANN.

The processor 180 may include a sub-module enabling an arithmetic operation of processing a voice and a natural language voice, like an input/output (I/O) processing module, an environment condition processing module, a speech-to-text (STT) processing module, a natural language processing module, a work flow processing module, and a service processing module.

Each of such sub-modules may access one or more systems or data and models or a subset or superset thereof in a terminal. Also, each of the sub-modules may provide various functions in addition to vocabulary index, user data, a work flow model, a service model, and an automatic speech recognition (ASR) system.

In another embodiment, another aspect of the processor 180 or a terminal may be implemented with the sub-module, system, or data and model.

In some embodiments, based on data of the learning processor 130, the processor 180 may be configured to detect and sense a requirement on the basis of an intention of a user or a context condition expressed as a user input or a natural language input.

The processor 180 may actively derive and obtain information which is needed in completely determining the requirement on the basis of the intention of the user or the context condition. For example, the processor 180 may analyze past data including an input log, an output log, pattern matching, unambiguous words, and an input intention, thereby actively deriving needed for determining the requirement.

The processor 180 may determine task flow for executing a function of responding to the requirement, based on the intention of the user or the context condition.

The processor 180 may be configured to collect, sense, extract, detect, and/or receive a signal or data used for data analysis and a machine learning operation through one or more sensing components in a terminal, for collecting information which is to be processed and stored in the learning processor 130.

Collecting of information may include an operation of sensing information through a sensor, an operation of extracting information stored in the memory 170, or an operation of receiving information through a communication means from another terminal, an entity, or an external storage device.

The processor 180 may collect usage history information from the terminal and may store the collected usage history information in the memory 170.

The processor 180 may determine an optimal match for executing a specific function by using the stored usage history information and prediction modeling.

The processor 180 may receive or sense ambient environmental information or other information through the sensing unit 140.

The processor 180 may receive a broadcast signal and/or broadcast-related information, a wireless signal, and wireless data through the wireless communication unit 110.

The processor 180 may receive image information (or a corresponding signal), audio information (or a corresponding signal), data, or user input information through the input unit 120.

The processor 180 may collect information in real time and may process or classify the collected information (for example, a knowledge graph, an instruction policy, an individualization database, a dialogue engine, etc.) and may store the processed information in the memory 170 or the learning processor 130.

When an operation of the terminal is determined based on the data analysis algorithm, the machine learning algorithm, and technique, the processor 180 may control elements of the terminal for executing the determined operation. Also, the processor 180 may control the terminal according to a control instruction to perform the determined operation.

When a specific operation is performed, the processor 180 may analyze history information representing execution of the specific operation through the data analysis algorithm, the machine learning algorithm, and technique and may update previously learned information, based on the analyzed information.

Therefore, the processor 180 may enhance an accuracy of a future performance of each of the data analysis algorithm, the machine learning algorithm, and the technique along with the learning processor 130, based on the updated information.

The sensing unit 140 may include at least one sensor for sensing at least one of information in a mobile terminal, environmental information around a mobile terminal, or user information.

For example, the sensing unit 140 may include at least one of a proximity sensor 141, an illumination sensor 142, a touch sensor, an acceleration sensor, a magnetic sensor, a G-sensor, a gyroscope sensor, a motion sensor, an RGB sensor, an infrared (IR) sensor, a finger scan sensor, an ultrasonic sensor, an optical sensor (for example, the camera 121), a microphone (for example, the microphone 122), a battery gauge, an environmental sensor (for example, a barometer, a hygrometer, a thermometer, a radiation sensor, a thermal sensor, and a gas sensor), or a chemical sensor (for example, an electronic nose, a healthcare sensor, and a biometric sensor). Moreover, a mobile terminal disclosed in this specification may combines information sensed by at least two or more sensors among such sensors and may then utilize it.

The output unit 150 is used to generate a visual, auditory, or haptic output and may include at least one of a display unit 151, a sound output module 152, a haptic module 153, or an optical output module 154.

The display unit 151 may display (output) information processed in the mobile terminal 100. For example, the display unit 151 may display execution screen information of an application program running on the mobile terminal 100 or user interface (UI) and graphic user interface (GUI) information according to such execution screen information.

The display unit 151 may be formed with a mutual layer structure with a touch sensor or formed integrally, so that a touch screen may be implemented. Such a touch screen may serve as the user input unit 123 providing an input interface between the mobile terminal 100 and a user, and an output interface between the mobile terminal 100 and a user at the same time.

The sound output module 152 may output audio data received from the wireless communication unit 110 or stored in the memory 170 in a call signal reception or call mode, a recording mode, a voice recognition mode, or a broadcast reception mode.

The sound output module 152 may include a receiver, a speaker, and a buzzer.

The haptic module 153 generates various haptic effects that a user can feel. A representative example of a haptic effect that the haptic module 153 generates is vibration.

The optical output module 154 outputs a signal for notifying event occurrence by using light of a light source of the mobile terminal 100. An example of an event occurring in the mobile terminal 100 includes message reception, call signal reception, missed calls, alarm, schedule notification, e-mail reception, and information reception through an application.

The interface unit 160 may serve as a path to various kinds of external devices connected to the mobile terminal 100. The interface unit 160 may include at least one of a wired/wireless headset port, an external charger port, a wired/wireless data port, a memory card port, a port connecting a device equipped with an identification module, an audio Input/Output (I/O) port, an image I/O port, and or an earphone port. In correspondence to that an external device is connected to the interface unit 160, the mobile terminal 100 may perform an appropriate control relating to the connected external device.

Moreover, the identification module, as a chip storing various information for authenticating usage authority of the mobile terminal 100, may include a user identity module (UIM), a subscriber identity module (SIM), and a universal subscriber identity module (USIM). A device equipped with an identification module (hereinafter referred to as an identification device) may be manufactured in a smart card form. Accordingly, the identification device may be connected to the terminal 100 through the interface unit 160.

The memory 170 may store data for supporting various functions of the terminal 100.

The memory 170 may store a plurality of application programs or applications executed in the terminal 100, pieces of data and instructions for an operation of the terminal 100, and pieces of data (for example, at least one piece of algorithm information for machine learning) for an operation of the learning processor 130.

The processor 180 may control overall operations of the mobile terminal 100 generally besides an operation relating to the application program. The processor 180 may provide appropriate information or functions to a user or process them by processing signals, data, and information inputted/outputted through the above components or executing application programs stored in the memory 170.

Additionally, in order to execute an application program stored in the memory 170, the processor 180 may control at least part of the components shown in FIG. 1. Furthermore, in order to execute the application program, the processor 180 may combine at least two of the components in the mobile terminal 100 and may then operate it.

As described above, the processor 180 may control an operation associated with an application program and an overall operation of the terminal 100. For example, when a state of the terminal 100 satisfies a predetermined condition, the processor 180 may execute or release a lock state which limits an input of a control command of a user for applications.

The power supply unit 190 may receive external power or internal power under a control of the processor 180 and may then supply power to each component in the mobile terminal 100. The power supply unit 190 includes a battery and the battery may be a built-in battery or a replaceable battery.

Figure 2:
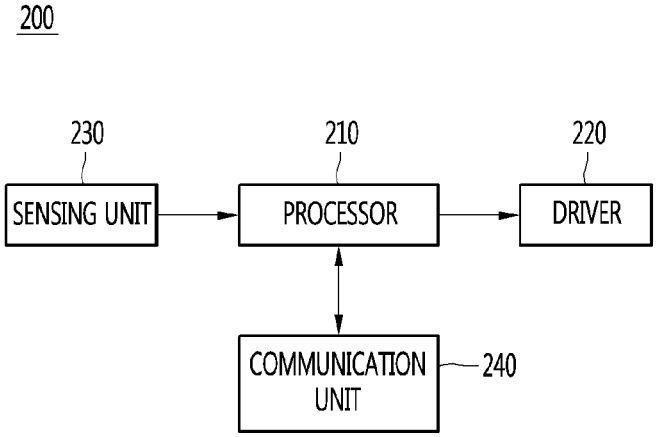
FIG. 2 is a block diagram for explanation of a massage chair 200 according to an embodiment of the present invention.

FIG. 2 is a block diagram for explanation of a massage chair 200 according to an embodiment of the present invention.

The massage chair 200 may include at least one of a processor 210, a driver 220, a sensing unit 230, or a communication unit 240.

The processor 210 may perform overall control of each of components of the massage chair 200. In detail, the processor 210 may control operations of the driver 220, the sensing unit 230, and the communication unit 240.

Under control of the processor 210, the driver 220 may generate force for performing massage.

The driver 220 may transmit the generated force to at least one of a head massage unit 310 configured to support the user head, a back massage unit 320 configured to the user back, an arm massage unit 330 configured to the user arm, a buttocks massage unit 340 configured to support the user buttocks, or a leg massage unit 350 configured to support the user leg.

The driver 220 may generate and transmit force for rotating at least one of the head massage unit 310 configured to support the user head, the back massage unit 320 configured to the user back, the arm massage unit 330 configured to the user arm, the buttocks massage unit 340 configured to support the user buttocks, or the leg massage unit 350 configured to support the user leg.

To this end, the driver 220 may include one or more motors configured to generate rotation force and a power transmitter configured to transmit the generated rotation force.

Each of the head massage unit 310, the back massage unit 320, the arm massage unit 330, the buttocks massage unit 340, and the leg massage unit 350 may include an airbag, and the driver 220 may adjust an air pressure of the airbag of each of the head massage unit 310, the back massage unit 320, the arm massage unit 330, the buttocks massage unit 340, and the leg massage unit 350 and may perform massage with various intensities.

The sensing unit 230 may acquire data for acquisition of information on at least one of a body type, a posture, or a position of a user.

In detail, the sensing unit 230 may include one or more sensors disposed on portions that the user contacts. Here, the one or more sensors may include at least one of a capacitance sensor, a pressure sensor, or a piezoelectric sensor and may acquire data on at least one of a contact surface or contact intensity when a user contacts the massage chair.

In this case, the processor 210 may acquire information on at least one of the body type, the posture, or the position of the user based on the data acquired by the sensing unit 230.

The sensor included in the sensing unit 230 is not limited to the aforementioned capacitance sensor, pressure sensor, and piezoelectric sensor and may be any sensor for collecting data for acquisition of information on at least one of the body type, the posture, or the position of the user, such as an ultrasonic sensor or an optical sensor.

The communication unit 240 may communicate with the mobile terminal 100. In detail, the communication unit 240 may be connected to the mobile terminal 100 by wire or wirelessly and may transmit data to the mobile terminal 100 or may transmit from the mobile terminal 100.

The massage chair may include a power supply unit and may supply power to components of the massage chair through the power supply unit.

Figure 3:
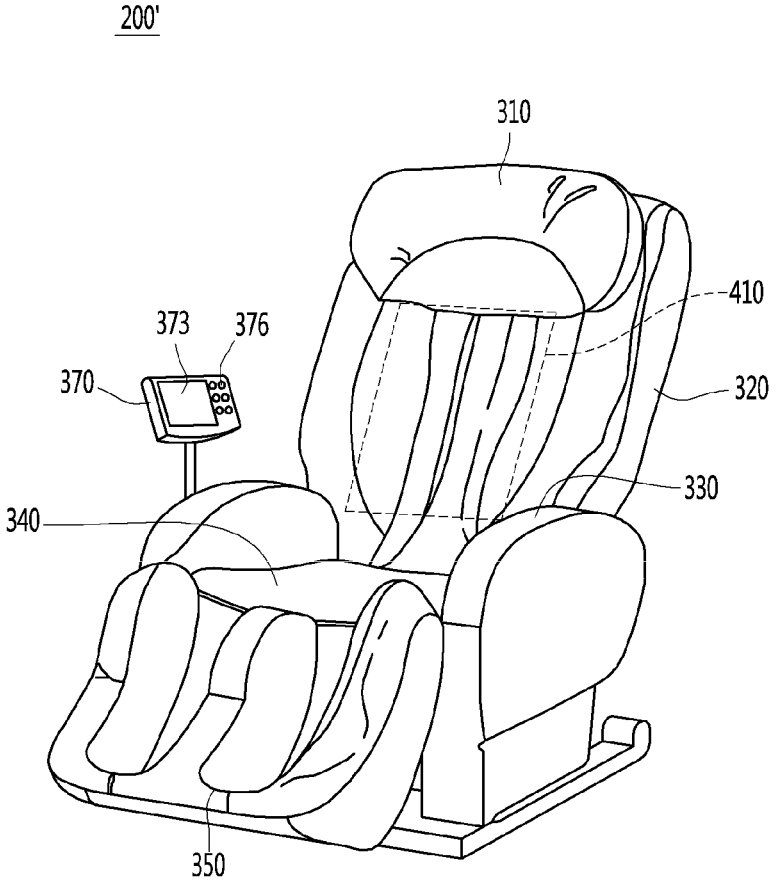
FIG. 3 is a perspective view for explanation of a configuration of the massage chair 200 according to an embodiment of the present invention.

FIG. 3 is a perspective view for explanation of a configuration of the massage chair 200 according to an embodiment of the present invention.

The massage chair 200 may include at least one of the head massage unit 310 configured to support the user head, the back massage unit 320 configured to the user back, the arm massage unit 330 configured to the user arm, the buttocks massage unit 340 configured to support the user buttocks, or the leg massage unit 350 configured to support the user leg.

At least one of the head massage unit 310, the back massage unit 320, the arm massage unit 330, the buttocks massage unit 340, or the leg massage unit 350 may be rotated in upward and downward directions by force transmitted from the driver 220.

Each of the head massage unit 310, the back massage unit 320, the arm massage unit 330, the buttocks massage unit 340, and the leg massage unit 350 may include one or more rollers or one or more massage sticks, and may perform a preset operation using the force transmitted from the driver 220 to perform massage.

Each of the head massage unit 310, the back massage unit 320, the arm massage unit 330, the buttocks massage unit 340, and the leg massage unit 350 may include an airbag. An air pressure of the airbag included in each of the head massage unit 310, the back massage unit 320, the arm massage unit 330, the buttocks massage unit 340, and the leg massage unit 350 may be adjusted, and thus massage with various intensities may be provided to the user.

The massage chair 200 may include a support that configures a structure of the inside of the massage chair 200.

The entire portion of the massage chair 200 may be rotated in left and right or upward and downward directions by the force transmitted from the driver 220.

The massage chair 200 may include a user interface unit 370. Here, the user interface unit 370 may include a display unit 373 configured to display information under control of the processor 210 and an input unit 376 configured to receive input from a user and to transmit the input to the processor 210.

Each of the head massage unit 310, the back massage unit 320, the arm massage unit 330, the buttocks massage unit 340, and the leg massage unit 350 may include one or more low-ranking massage devices. For example, the head massage unit 310 may include at least one of a head massage device configured to perform massage on the user head, or a neck massage device configured to perform massage on the user neck. In another example, the back massage unit 320 may include at least one a shoulder massage device configured to perform massage on the user shoulder, a shoulder massage device configured to perform massage on the user back, and a back massage device configured to perform massage on the user waist. In another example, the leg massage unit 350 may include at least one of a thigh massage device configured to perform massage on the user thigh, a calf massage device configured to perform massage on the user calf, or a foot massage device configured to perform massage on the user foot.

Although the configuration and operation method of the massage chair 200 have been described above, the present invention is not limited to the aforementioned massage chair 200. In detail, various documents disclose the configuration and operation method of the massage chair, and the massage chair 200 according to an embodiment of the present invention may be applied various known types of massage chairs.

Figure 4:
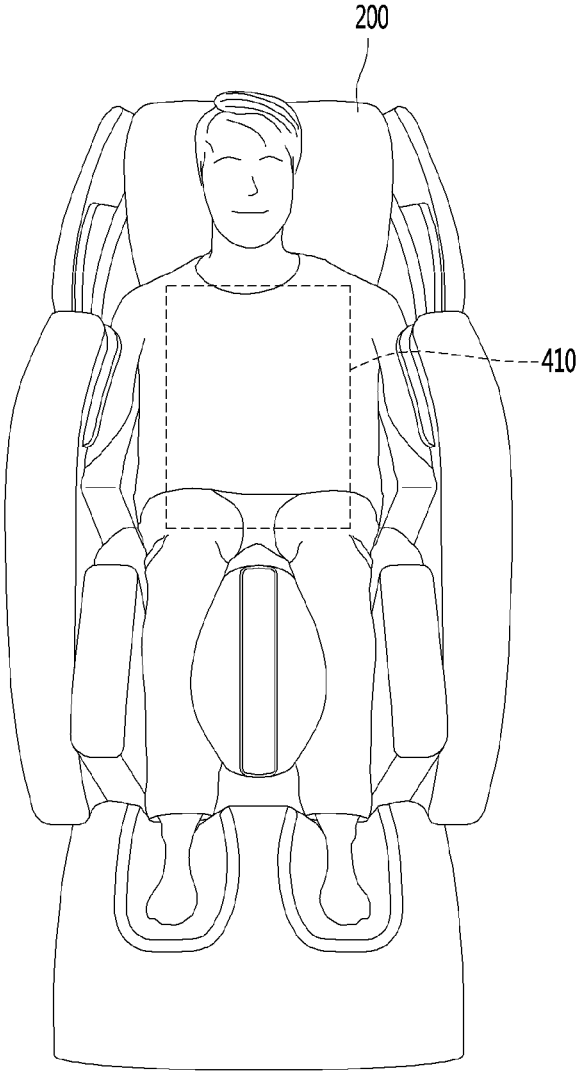
FIG. 4 is a diagram showing the case in which a user gets massage on a massage chair according to an embodiment of the present invention.

FIG. 4 is a diagram showing the case in which a user gets massage on a massage chair according to an embodiment of the present invention.

A wireless communication unit of the mobile terminal 100 may be connected to the communication unit 240 of the massage chair 200 and may transmit and receive data In detail, a processor of the mobile terminal 100 may receive input for determining a massage pattern from the user who sits on the massage chair and may transmit the massage pattern to the massage chair 200.

In this case, the processor of the massage chair 200 may receive the massage pattern from the mobile terminal 100 and may control a driver to perform an operation corresponding to the received massage pattern.

Referring back to FIGS. 3 and 4, the massage chair may include a vibration array 410.

Here, the vibration array 410 may be disposed on a surface that a user body contacts or an internal portion of the massage chair and may apply a stimulus to the user who sits on the massage chair.

As shown in FIGS. 3 and 4, the vibration array 410 may be disposed on the back massage unit 320, and hereinafter, the vibration array 410 is assumed to be disposed on the back massage unit 320.

However, the present invention is not limited thereto, and the vibration array 410 may be disposed on the head massage unit 310, the arm massage unit 330, the buttocks massage unit 340, the leg massage unit 350, or the like.

Figure 5:
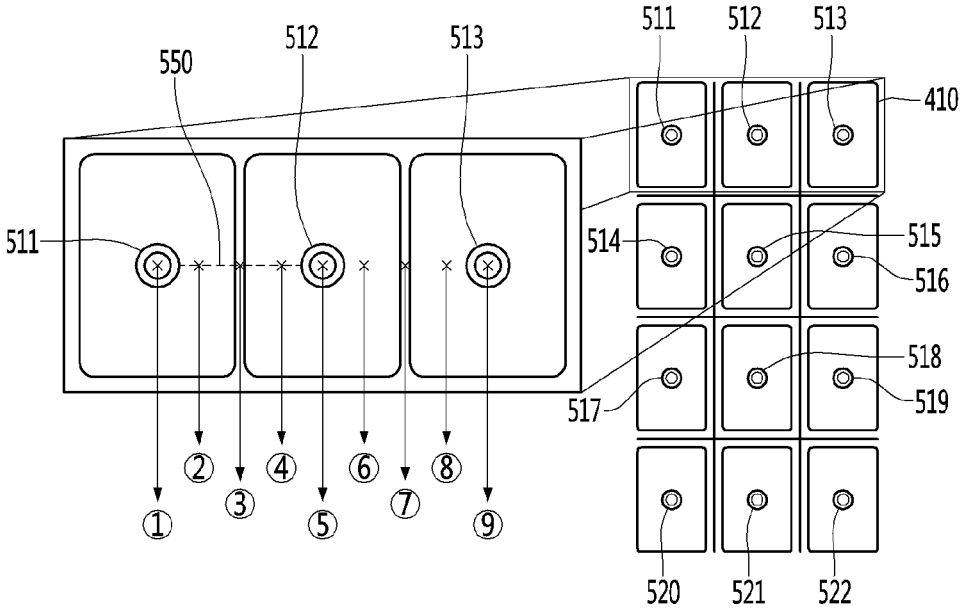
FIG. 5 is a diagram for explanation of a plurality of vibration devices and a method of generating a stimulus using the plurality of vibration devices according to an embodiment of the present invention.

FIG. 5 is a diagram for explanation of a plurality of vibration devices and a method of generating a stimulus using the plurality of vibration devices according to an embodiment of the present invention.

The vibration array 410 may include a plurality of vibration devices 511, 512, 513, 514, 515, 516, 517, 518, 519, 520, 521, and 522.

For example, the vibration array 410 may include a plurality of vibration devices (e.g., the first to third vibration devices 511 to 513) that are horizontally arranged.

In another example, the vibration array 410 may include a plurality of vibration devices (e.g., the first, fourth, seventh, and tenth vibration devices 511, 514, 517, and 520) that are vertically arranged.

In another example, the vibration array 410 may include plurality of vibration devices (e.g., the first to sixth vibration devices 511 to 516) that are vertically and horizontally arranged.

The plurality of vibration devices 511, 512, 513, 514, 515, 516, 517, 518, 519, 520, 521, and 522 may generate a haptic effect of applying a stimulus to the user, and for example, may generate vibration under control of the processor 210.

In detail, upon receiving current, the plurality of vibration devices 511, 512, 513, 514, 515, 516, 517, 518, 519, 520, 521, and 522 may generate vibration through upward and downward movement, rotation movement, and the like.

The driver 220 may vibrate the plurality of vibration devices.

In detail, the driver 220 may include a plurality of vibration motors that are connected to the plurality of vibration devices 511, 512, 513, 514, 515, 516, 517, 518, 519, 520, 521, and 522, respectively. The driver 220 may include a power transfer circuit configured to supply power to a plurality of vibration motors.

The driver 220 may supply power supplied from a power supply device to a plurality of vibration motors under control of the processor 210.

The processor 210 may generate a control signal for controlling each of the plurality of vibration devices 511, 512, 513, 514, 515, 516, 517, 518, 519, 520, 521, and 522 and may transmit the control signal to the driver 220.

For example, the processor 210 may output a first control signal for control of a first vibration device 511, a second control signal for control of a second vibration device 512, a fourth control signal for control of a fourth vibration device 514, and a fifth control signal for control of a fifth vibration device 515.

Upon receiving the control signal, the driver 220 may separately supply power to a plurality of motors and may separately vibrate the plurality of vibration devices 511, 512, 513, 514, 515, 516, 517, 518, 519, 520, 521, and 522.

The processor 210 may simultaneously vibrate two or more vibration devices among the plurality of vibration devices 511, 512, 513, 514, 515, 516, 517, 518, 519, 520, 521, and 522.

For example, the processor 210 may output the first control signal for vibration of the first vibration device 511 and the second control signal for vibration of the second vibration device 512.

In this case, the driver 220 may supply current to a first vibration motor connected to the first vibration device 511 based on the first control signal to vibrate the first vibration device 511 and may supply current to a second vibration motor connected to the second vibration device 512 based on the second control signal to vibrate the second vibration device 512. Third to twelfth control signals for vibration of third to twelfth vibration devices 513 to 522 are not output, and thus the driver 220 may not supply current to third to twelfth vibration motors that are connected to the third to twelfth vibration devices 513 to 522, respectively. Accordingly, the third to twelfth vibration devices 513 to 522 may not vibrate.

A stimulus point may refer to a point of a user, to which a stimulus is applied.

For example, when the first vibration device 511 vibrates, the stimulus point may be a point ① at which the first vibration device 511 is positioned. In another example, when the second vibration device 512 vibrates, the stimulus point may be a point ⑤ at which the second vibration device 512 is positioned.

The processor 210 may simultaneously vibrate two or more vibration devices among the plurality of vibration devices to generate a stimulus at a stimulus point between the plurality of vibration devices.

Here, the stimulus point between the plurality of vibration devices may be a predetermined point of the vibration array 410 except for points at which the plurality of vibration devices are disposed. The stimulus point between the plurality of vibration devices may be a predetermined point on a line for connecting points on which the outermost vibration devices 511, 512, 513, 516, 519, 522, 521, 520, 517, and 514 are disposed or a predetermined point within a figure generated by connecting the outermost vibration devices 511, 512, 513, 516, 519, 522, 521, 520, 517, and 514.

First, a haptic phenomenon used to generate a stimulus at a stimulus point between a plurality of vibration devices will be described.

A haptic illusion phenomenon may occur in the human. A representative haptic illusion phenomenon may be a phenomenon whereby a soldier who misses a leg in a war feels pain.

Phantom sensation may refer to a phenomenon whereby a stimulus is generated at one point between two points under a specific condition when stimuli are generated at two neighboring points of a skin surface.

Sensory saltation may be an illusion phenomenon of somatic senses and may refer to a phenomenon whereby illusion is caused as if a stimulus continuously moves between stimulus points under a specific condition when a stimulus with repeated and rapid sequences is generated on a skin surface at two or more points.

The processor 210 may generate a stimulus at a stimulus point between the plurality of vibration devices based on at least one of sensory saltation or phantom sensation. In this case, a stimulus point may be formed at a predetermined point between the plurality of vibration devices, but not at points at which the plurality of vibration devices are positioned, and thus the user may feel a stimulus at a point that contacts a predetermined point between the plurality of vibration devices.

First, a method of generating a stimulus at a stimulus point between two vibration devices will be described.

The plurality of vibration devices 511, 512, and 513 that are horizontally arranged will be exemplified.

The processor 210 may control the driver to simultaneously vibrate a first vibration device and a second vibration device, which are adjacent to the stimulus point, and to generate a stimulus at a stimulus point between the first vibration device and the second vibration device.

In detail, the processor 210 may determine a stimulus point. When the stimulus point is positioned between the first vibration device 511 and the second vibration device 512, it may be determined that the first vibration device and second vibration device are adjacent to the stimulus point.

Here, when the stimulus point is positioned between the first vibration device 511 and the second vibration device 512, this means that the stimulus point is positioned on an imaginary line 550 for connecting the first vibration device 511 and the second vibration device 512.

When the first vibration device and the second vibration device are adjacent to the stimulus point, this means that any one of the first vibration device and the second vibration device is most adjacent to the stimulus point and the other one of the first vibration device and the second vibration device is secondly adjacent to the stimulus point among the plurality of vibration devices 511 to 522 or that the first vibration device and the second vibration device are most adjacent to the stimulus point.

When the stimulus point is positioned between the first vibration device 511 and the second vibration device 512, the processor 210 may simultaneously vibrate the first vibration device 511 and the second vibration device 512 which are adjacent to the stimulus point.

In this case, the processor 210 may simultaneously vibrate the first vibration device 511 and the second vibration device 512 under a condition where at least one phenomenon of phantom sensation or sensory saltation occurs.

In this case, the processor 210 may output the first control signal for vibration of the first vibration device 511 and the second control signal for vibration of the second vibration device 512 among the plurality of vibration devices 511 to 522.

Accordingly, a user who sits on the massage chair may recognize a stimulus generated at a stimulus point between the first vibration device 511 and the second vibration device 512.

The processor may determine vibration intensity of vibration devices based on a distance between the stimulus point and vibration devices.

This will be described with reference to FIG. 6.

Figure 6:
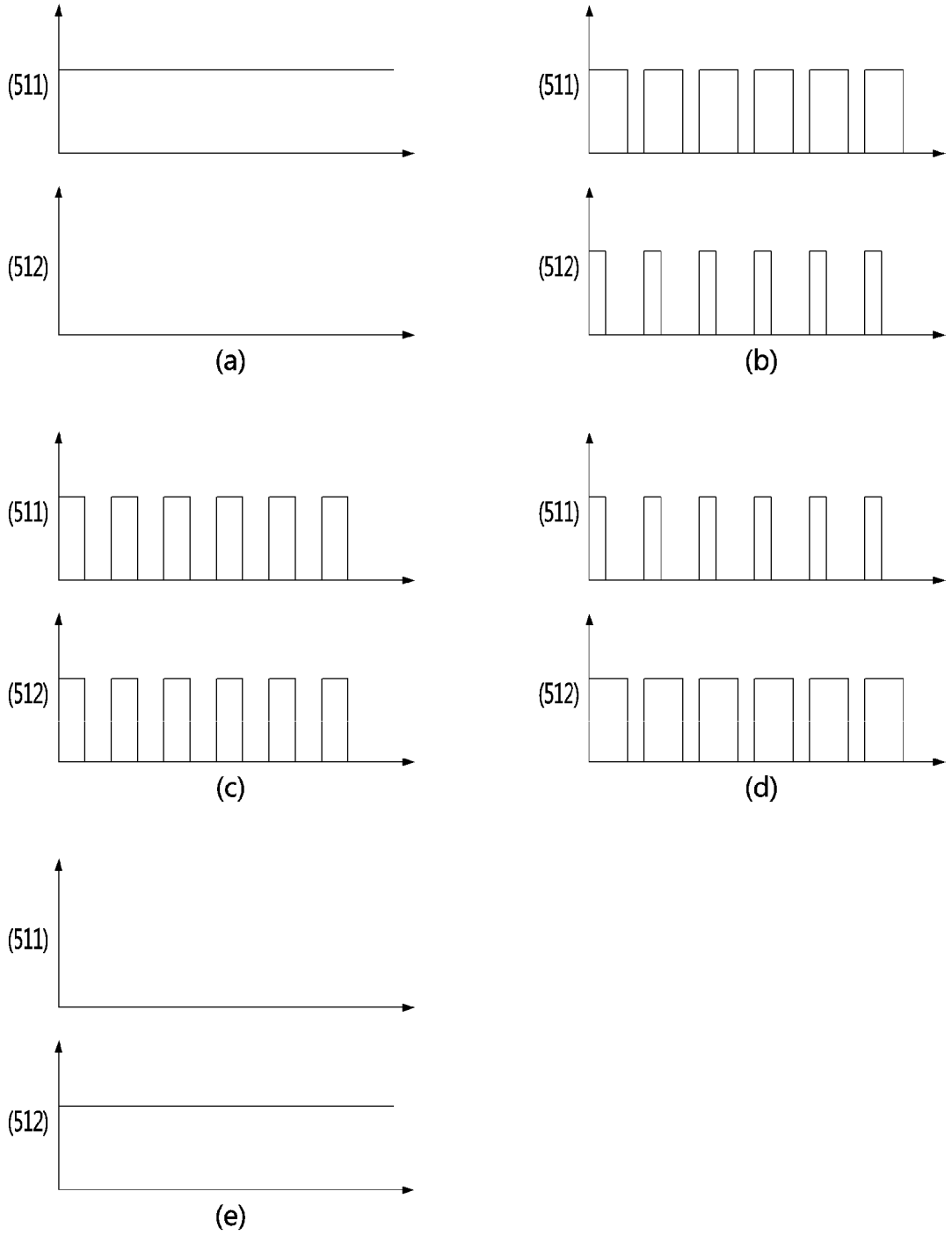
FIG. 6 is a graph showing vibration of a first vibration device and vibration of a second vibration device.

FIG. 6 is a graph showing vibration of a first vibration device and vibration of a second vibration device.

In the graph of FIG. 6, the x axis is a time and the y axis is amplitude of vibration of a vibration device (displacement, e.g., amplitude of upward and downward movement when a vibration device moves in upward and downward directions).

Vibration intensity may be determined based on at least one of a duty cycle of vibration of a vibration device or amplitude of vibration (displacement, e.g., amplitude of upward and downward movement when a vibration device moves in upward and downward directions).

In detail, as a duty cycle of vibration of a vibration device increases, vibration intensity generated by the vibration device may be increased. In addition, as amplitude of vibration of the vibration device (displacement, e.g., amplitude of upward and downward movement when a vibration device moves in upward and downward directions) increases, vibration intensity generated by the vibration device may be increased.

Hereinafter, adjustment of vibration intensity will be described as a method of changing a duty cycle of vibration of a vibration device, but the present invention is not limited thereto and vibration intensity may also be adjusted using a method of changing amplitude of vibration.

A processor may determine vibration intensity of a first vibration device and vibration intensity of a second vibration device based on a first distance between a stimulus point and a first vibration device and a second distance between the stimulus point and a second vibration device.

In detail, a ratio of the second distance to the first distance may be equal to a ratio of the first vibration intensity to the second vibration intensity.

In this regard, first, a case in which a stimulus point is a point ② of FIG. 5.

When the stimulus point is the point ②, a vibration device adjacent to the stimulus point among a plurality of vibration devices may be the first vibration device 511 and the second vibration device 512.

The processor may control the driver to generate a stimulus at a stimulus point ② between the first vibration device and the second vibration device by simultaneously vibrating the first vibration device 511 and the second vibration device 512, which are adjacent to the stimulus point.

In this case, the processor may determine first vibration intensity of the first vibration device 511 and second vibration intensity of the second vibration device 512 based on a first distance between the stimulus point ② and the first vibration device 511 and a second distance between the stimulus point ② and the second vibration device 512.

In detail, a ratio of the second distance to the first distance may be equal to a ratio of the first vibration intensity to the second vibration intensity.

For example, it is assumed that the first distance between the stimulus point ② and the first vibration device 511 is 2 cm and that the second distance between the stimulus point ② and the second vibration device 512 is 6 cm. In this case, the second distance may be three times the first distance, and a ratio of the second distance to the first distance may be 3.

In this case, a ratio of the first vibration intensity of the first vibration device 511 to the second vibration intensity of the second vibration device 512 may be 3. That is, the first vibration intensity of the first vibration device 511 may be three times the second vibration intensity of the second vibration device 512.

When the second distance is a specific multiple (e.g., three times) of the first distance, the processor may control the driver to make vibration intensity of the first vibration device 511 be a specific multiple (e.g., three times) of vibration intensity of the second vibration device 512.

For example, as shown in FIG. 6B, the processor may output a first control signal and a second control signal to make a duty cycle of vibration of the first vibration device 511 be a specific multiple (e.g., three times) of a duty cycle of vibration of the second vibration device 512.

As different expression, vibration intensity of a vibration device for generating a stimulus at a point at which the vibration device is disposed may be a duty cycle of 100%, and the sum of vibration intensities of vibration devices for generating a stimulus at a stimulus point between a plurality of vibration devices may also be a duty cycle of 100%. In this case, the processor may output the first control signal and the second control signal to make vibration intensity of the first vibration device 511 be a duty cycle of 75% and to make vibration intensity of the second vibration device 512 be a duty cycle of 25%.

Hereinafter, a case in which a stimulus point is a point ③ of FIG. 5 will be described.

When the stimulus point is the point ③, a vibration device adjacent to the stimulus point among a plurality of vibration devices may be the first vibration device 511 and the second vibration device 512.

The processor may control the driver to generate a stimulus at a stimulus point ③ between the first vibration device and the second vibration device by simultaneously vibrating the first vibration device and the second vibration device, which are adjacent to the stimulus point.

In this case, the processor may determine vibration intensity of the first vibration device 511 and vibration intensity of the second vibration device 512 based on a first distance between the stimulus point ③ and the first vibration device 511 and a second distance between the stimulus point ③ and the second vibration device 512.

In detail, a ratio of the second distance to the first distance may be equal to a ratio of the first vibration intensity to the second vibration intensity.

For example, it is assumed that the first distance between the stimulus point ② and the first vibration device 511 is 4 cm and that the distance between the stimulus point ② and the second vibration device 512 is 4 cm. In this case, the first distance and the second distance may be equal to each other, and a ratio of the second distance to the first distance may be 1.

In this case, a ratio of the first vibration intensity of the first vibration device 511 to the second vibration intensity of the second vibration device 512 may be 1. That is, the first vibration intensity of the first vibration device 511 and the second vibration intensity of the second vibration device 512 may be equal to each other.

When the second distance is a specific multiple (e.g., one time) of the first distance, the processor may control the driver to make vibration intensity of the first vibration device 511 be a specific multiple (e.g., one time) of vibration intensity of the second vibration device 512.

For example, as shown in FIG. 6C, the processor may output a first control signal and a second control signal to make a duty cycle of vibration of the first vibration device 511 be equal to a duty cycle of vibration of the second vibration device 512.

As different expression, the processor may output the first control signal and the second control signal to make the vibration intensity of the first vibration device 511 be a duty cycle of 50% and to make vibration intensity of the second vibration device 512 be a duty cycle of 50%.

Hereinafter, a case in which a stimulus point is a point ④ of FIG. 5.

When the stimulus point is the point ④, a vibration device adjacent to the stimulus point among a plurality of vibration devices may be the first vibration device 511 and the second vibration device 512.

In this case, the processor may determine vibration intensity of the first vibration device 511 and vibration intensity of the second vibration device 512 based on a first distance between the stimulus point ④ and the first vibration device 511 and a second distance between the stimulus point ④ and the second vibration device 512.

In detail, a ratio of the second distance to the first distance may be equal to a ratio of the first vibration intensity to the second vibration intensity.

For example, it is assumed that the first distance between the stimulus point ④ and the first vibration device 511 is 6 cm and that the distance between the stimulus point ② and the second vibration device 512 is 2 cm. In this case, the second distance may be ⅓ times the first distance, and a ratio of the second distance to the first distance may be ⅓.

In this case, a ratio of the first vibration intensity of the first vibration device 511 to the second vibration intensity of the second vibration device 512 may be ⅓. That is, the first vibration intensity of the first vibration device 511 may be ⅓ times the second vibration intensity of the second vibration device 512.

When the second distance is a specific multiple (e.g., ⅓ times) of the first distance, the processor may control the driver to make vibration intensity of the first vibration device 511 be a specific multiple (e.g., ⅓ times) of vibration intensity of the second vibration device 512.

For example, as shown in FIG. 6D, the processor may output a first control signal and a second control signal to make a duty cycle of vibration of the first vibration device 511 be a specific multiple (e.g., ⅓ times) of a duty cycle of vibration of the second vibration device 512.

As different expression, the processor may output the first control signal and the second control signal to make vibration intensity of the first vibration device 511 be a duty cycle of 25% and to make vibration intensity of the second vibration device 512 be a duty cycle of 75%.

When a stimulus point is a point in which a vibration device is positioned like points ① and ⑤ of FIG. 5, the processor may vibrate a corresponding vibration device.

For example, when the stimulus point is the point ①, the processor may vibrate the first vibration device 511 positioned at the point ①, as shown in FIG. 6A. As difference expression, when the stimulus point is the point ①, the processor may output the first control signal to make vibration intensity of the first vibration device 511 be 100%.

In another example, when the stimulus point is a point ⑤, the processor may vibrate the second vibration device 512 positioned at the point ⑤, as shown in FIG. 6E. As different expression, when the stimulus point is the point ⑤, the processor may output the second control signal to make vibration intensity of the second vibration device 512 be 100%.

The processor may change intensity of a vibration device or may change a vibrating vibration device to move the stimulus point.

First, a method of changing intensity of a vibration device to move a stimulus point will be described under the assumption that the stimulus point is moved to the point ⑤ from the point ① of FIG. 5 through points ②, ③, and ④.

The point ① may be a point at which the first vibration device 511 is positioned.

In this case, as shown in FIG. 6A, the processor may vibrate the first vibration device 511 positioned at the point ①. The second vibration device 512 may not vibrate. That is, the processor may output the first control signal to make vibration intensity of the first vibration device 511 be 100%.

Then, the processor may vibrate the first vibration device with the first vibration intensity among the first vibration device and the second vibration device which are adjacent to the stimulus point and may vibrate the second vibration device with smaller second vibration intensity than the first vibration intensity to generate a stimulus at the first stimulus point closer to the first vibration device than the second vibration device.

For example, when the stimulus point is the point ②, the processor may vibrate the first vibration device 511 with vibration intensity of 75% among the first vibration device 511 and the second vibration device 512 which are adjacent to the point ② and may vibrate the second vibration device 512 with vibration intensity of 25%. Accordingly, a stimulus may be generated at the point ② closer to the first vibration device 511 than the second vibration device 512 (refer to FIG. 6B).

Then, the processor may vibrate the first vibration device and the second vibration device, which are adjacent to the stimulus point, with the same intensity, and may generate a stimulus at an intermediate point between the first vibration device and the second vibration device.

For example, when the stimulus point is the point ③, the processor may vibrate the first vibration device 511 adjacent to the point ③ with vibration intensity of 50% and may vibrate the second vibration device 512 adjacent to the point ③ with vibration intensity of 50%. Accordingly, a stimulus may be generated at the point ③ that is the intermediate point between the second vibration device 512 and the first vibration device 511 (refer to FIG. 6C).

Then, the processor may vibrate the first vibration device with third vibration intensity among the first vibration device and the second vibration device, which are adjacent to the stimulus point and may vibrate the second vibration device with fourth vibration intensity greater than the third vibration intensity to generate a stimulus at the closer second stimulus point to the second vibration device than the first vibration device.

For example, when the stimulus point is the point ④, the processor may vibrate the first vibration device 511 with vibration intensity of 25% among the first vibration device 511 and the second vibration device 512, which are adjacent to the point ④ and may vibrate the second vibration device 512 with vibration intensity of 75%. Accordingly, a stimulus may be generated at the point ④ closer to the second vibration device 512 than the first vibration device 511 (refer to FIG. 6D).

Then, as shown in FIG. 6E, the processor may vibrate the second vibration device 512 positioned at the point ⑤. The first vibration device 511 may not vibrate. That is, the processor may output the second control signal to make vibration intensity of the second vibration device 512 be 100%.

The processor may control the first vibration device and the second vibration device to move the stimulus point in this manner.

For example, the processor may output the first control signal and the second control signal and may generate a stimulus at the point ① to make vibration intensity of the first vibration device be 100% and to make vibration intensity of the second vibration device be 0%. Then, the processor may output the first control signal and the second control signal and may generate a stimulus at the point ② to make vibration intensity of first vibration device be 75% and to make vibration intensity of the second vibration device be 25%. Then, the processor may output the first control signal and the second control signal and may generate a stimulus at the point ③ to make vibration intensity of the first vibration device be 50% and to make vibration intensity of the second vibration device be 50%. Then, the processor may output the first control signal and the second control signal and may generate a stimulus at the point ④ to make vibration intensity of the first vibration device be 25% and to make vibration intensity of the second vibration device be 75%. Then, the processor may output the first control signal and the second control signal and may generate a stimulus at the point ⑤ to make vibration intensity of the first vibration device be 0% and to make vibration intensity of the second vibration device be 100%.

Hereinafter, a method of changing intensity of a vibration device and a vibrating vibration device to move a stimulus point will be described.

Figure 7:
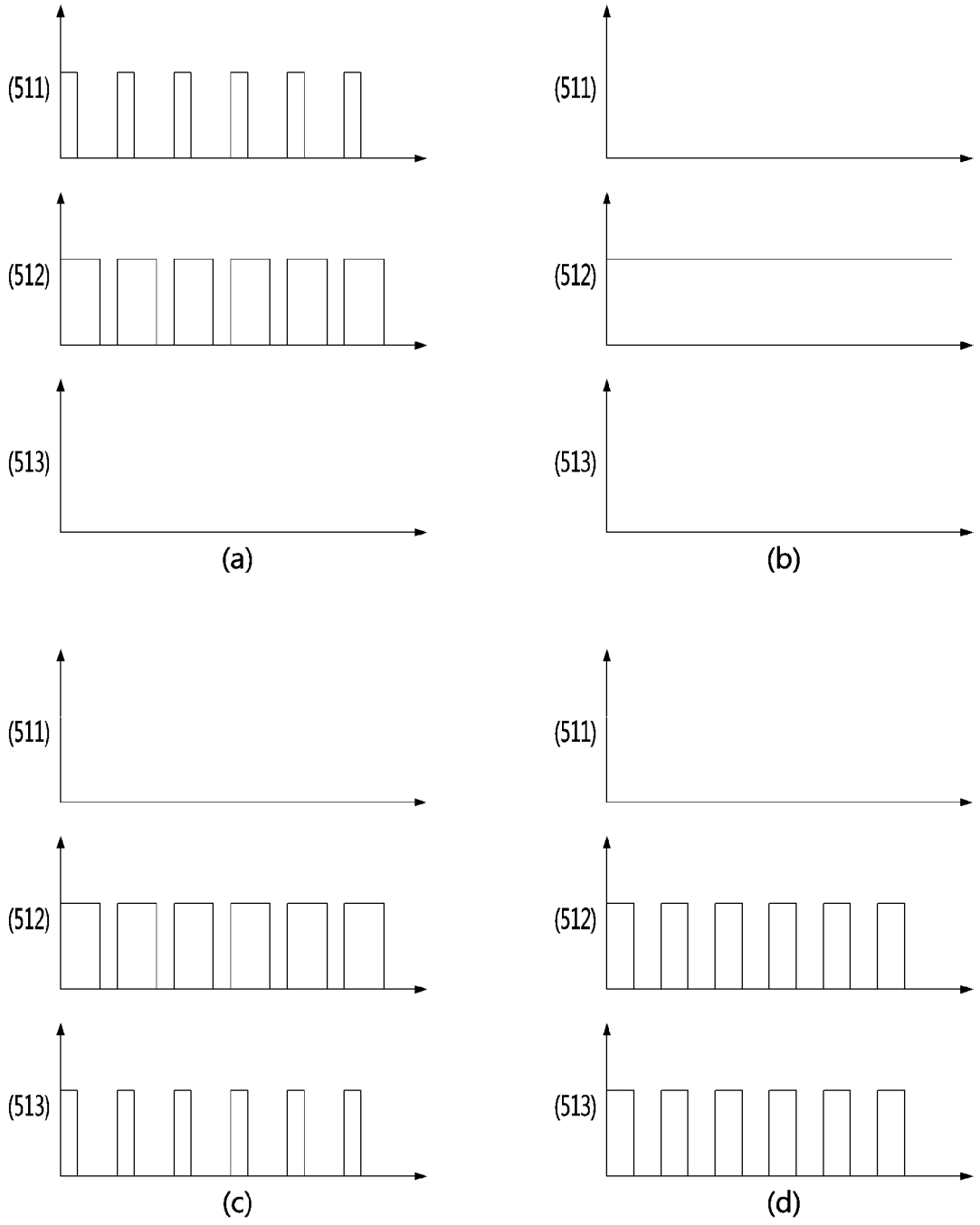
FIG. 7 is a diagram for explanation of a method of changing vibration intensity and a vibrating vibration device in order to change a stimulus point according to an embodiment of the present invention.

FIG. 7 is a diagram for explanation of a method of changing vibration intensity and a vibrating vibration device in order to change a stimulus point according to an embodiment of the present invention.

The method will be described under the assumption that the stimulus point is moved to the point ⑦ from the point ④ of FIG. 5 through points ⑤ and ⑥.

The processor may simultaneously vibrate the first vibration device and the second vibration device, which are adjacent to the stimulus point, to generate a stimulus at a stimulus point between the first vibration device and the second vibration device.

For example, when the stimulus point is the point ④, a vibration device adjacent to the stimulus point may be the first vibration device 511 and the second vibration device 512.

The first distance between the stimulus point ④ and the first vibration device 511 may be 6 cm and the distance between the stimulus point ② and the second vibration device 512 may be 2 cm. In this case, the second distance may be ⅓ times the first distance, and a ratio of the second distance to the first distance may be ⅓.

Accordingly, the processor may control the driver to make vibration intensity of the first vibration device 511 be ⅓ times vibration intensity of the second vibration device 512.

For example, as shown in FIG. 7A, the processor may output the first control signal and the second control signal to make a duty cycle of vibration of the first vibration device 511 be ⅓ times a duty cycle of vibration of the second vibration device 512.

That is, the processor may output the first control signal and the second control signal to make vibration intensity of the first vibration device 511 be 25% and to make vibration intensity of the second vibration device 512 be 75%.

The vibration device adjacent to the stimulus point ② may be the first vibration device 511 and the second vibration device 512. Accordingly, the third vibration device 513 and other vibration devices may not vibrate (It may be possible to vibrate the third vibration device 513 or other vibration devices to cause a separate stimulus to a user body. However, vibration of the third vibration device 513 or the other vibration devices are not used to generate a stimulus point using phantom sensation and sensory saltation).

The processor may control the driver to change the stimulus point to point ⑤ from the point ④ of FIG. 5.

In detail, the point ⑤ may be a point at which the second vibration device 512 is positioned.

In this case, as shown in FIG. 7B, the processor may vibrate the second vibration device 512 positioned at the point ⑤. In this case, the processor may output the second control signal to make vibration intensity of the second vibration device 512 be 100%.

The first vibration device 511, the third vibration device 513, and other vibration devices may not vibrate.

The processor may control the driver to change the stimulus point to the point ⑥ from the point ⑤ of FIG. 5.

In detail, the processor may simultaneously vibrate the second vibration device and the third vibration device, which are adjacent to a new stimulus point, to generate a stimulus at a stimulus point between the second vibration device and the third vibration device.

For example, when the stimulus point is the point ⑥, the vibration device adjacent to the stimulus point may be the second vibration device 512 and the third vibration device 513.

A third distance between the stimulus point ⑥ and the second vibration device 512 may be 2 cm and a fourth distance between the stimulus point ⑥ and the third vibration device 513 may be 6 cm. In this case, the fourth distance may be three times the third distance, and a ratio of the fourth distance to the third distance may be 3.

Accordingly, the processor may control the driver to make vibration intensity of the second vibration device 512 be three times vibration intensity of the third vibration device 513.

For example, as shown in FIG. 7C, the processor may output a second control signal and a third control signal to make a duty cycle of vibration of the second vibration device 512 be three times a duty cycle of vibration of the third vibration device 513.

That is, the processor may output the second control signal and the third control signal to make vibration intensity of the second vibration device 512 be 75% and to make vibration intensity of the third vibration device 513 be 25%.

A vibration device adjacent to the stimulus point ⑥ may be the second vibration device 512 and the third vibration device 513. Accordingly, the first vibration device 511 and other vibration devices may not vibrate.

The processor may control the driver to change the stimulus point to the point ⑦ from the point ⑥ of FIG. 5.

In detail, the processor may vibrate the second vibration device 512 and the third vibration device 513, which are adjacent to the stimulus point ⑦, with the same intensity, and may generate a stimulus at an intermediate point between the second vibration device 512 and the third vibration device 513. That is, as shown in FIG. 7D, the processor may vibrate the second vibration device 512 and the third vibration device 513, which are adjacent to the stimulus point ⑦, with vibration intensity of 50%.

A vibration device adjacent to the stimulus point ⑦ may be the second vibration device 512 and the third vibration device 513. Accordingly, the first vibration device 511 and other vibration devices may not vibrate.

The processor may control the first vibration device, the second vibration device, and the third vibration device to move the stimulus point in this manner.

For example, the processor may output the first control signal, the second control signal, and the third control signal and may generate a stimulus at the point ④ to make vibration intensity of the first vibration device be 25%, to make vibration intensity of the second vibration device be 75%, and make vibration intensity of the third vibration device be 0%. Then, the processor may output the first control signal, the second control signal, and the third control signal and may generate a stimulus at the point ⑤ to make vibration intensity of the first vibration device be 0%, to make vibration intensity of the second vibration device be 100%, and to make vibration intensity of the third vibration device be 0%. Then, the processor may output the first control signal, the second control signal, and the third control signal and may generate a stimulus at the point ⑥ to make vibration intensity of the first vibration device be 0%, to make vibration intensity of the second vibration device be 75%, and to make vibration intensity of the third vibration device be 25%. Then, the processor may output the first control signal, the second control signal, and the third control signal and may generate a stimulus at the point ⑦ to make vibration intensity of the first vibration device be 0%, to make vibration intensity of the second vibration device be 50%, and to make vibration intensity of the third vibration device be 50%.

In the above embodiment, a method of applying a stimulus to various stimulus points and a method of moving a stimulus point when vibration devices are horizontally arranged have been described. In addition, such a description may also be applied to the case in which vibration devices are vertically or diagonally arranged, without change.

Hereinafter, a method of applying a stimulus at various stimulus points and a method of moving a stimulus point by a vibration array including a plurality of vibration devices that are vertically and horizontally arranged will be described.

Figure 8:
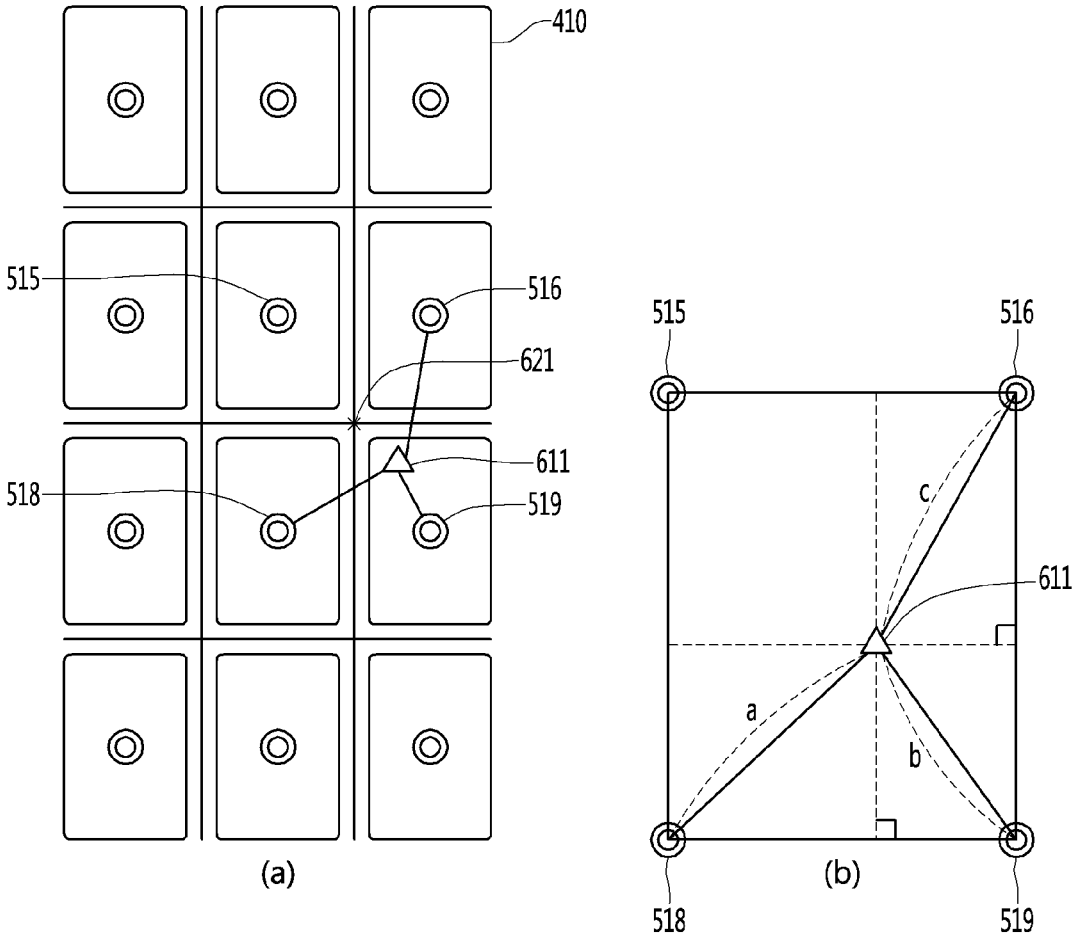
FIG. 8 is a diagram for explanation of a method of generating a stimulus at a stimulus point between a plurality of vibration devices by a vibration array in which vibration devices are vertically and horizontally arranged.

FIG. 8 is a diagram for explanation of a method of generating a stimulus at a stimulus point between a plurality of vibration devices by a vibration array in which vibration devices are vertically and horizontally arranged.

A vibration array 510 may include the plurality of vibration devices 511, 512, 513, 514, 515, 516, 517, 518, 519, 520, 521, and 522 that are vertically and horizontally arranged.

The processor may control the driver to simultaneously vibrate a sixth vibration device 516, an eighth vibration device 518, and a ninth vibration device 519, which are adjacent to a stimulus point, to generate a stimulus at a stimulus point.

In detail, the processor 210 may determine a stimulus point 611. The processor may select four vibration devices 515, 516, 518, and 519 that form a figure for surrounding the stimulus point 611 at the closest distance if being connected to each other, among the plurality of vibration devices 511, 512, 513, 514, 515, 516, 517, 518, 519, 520, 521, and 522. The processor 210 may determine the sixth vibration device 516, the eighth vibration device 518, and the ninth vibration device 519, which are three vibration devices closest to the stimulus point 611 among the four vibration devices 515, 516, 518, and 519, as vibration devices adjacent to the stimulus point.

The processor may simultaneously vibrate the sixth vibration device 516, the eighth vibration device 518, and the ninth vibration device 519, which are three vibration devices close to the stimulus point 611.

In this case, the processor 210 may vibrate three vibration devices close to the stimulus point 611 under a condition in which at least one of phantom sensation or sensory saltation is to be caused.

Accordingly, a stimulus may be generated at a stimulus point between the sixth vibration device 516, the eighth vibration device 518, and the ninth vibration device 519 based on at least one of phantom sensation or sensory saltation, and a user who sits on a massage chair may recognize the stimulus generated at the stimulus point between the sixth vibration device 516, the eighth vibration device 518, and the ninth vibration device 519.

The processor may determine vibration intensity of vibration devices based on distances between a stimulus point and vibration devices.

In detail, the processor may determine first vibration intensity of a sixth vibration device, second vibration intensity of an eighth vibration device, and third vibration intensity of a ninth vibration device based on a 'first distance 'c' between the stimulus point 611 and a sixth vibration device 516', a 'second distance 'a' between the stimulus point 611 and the eighth vibration device 518, and a 'third distance 'b' between the stimulus point 611 and the ninth vibration device 519'.

In more detail, a ratio of the second distance to the first distance may be equal to a ratio of the first vibration intensity to the second vibration intensity, and a ratio of the third distance to the first distance may be equal to a ratio of the first vibration intensity to the third vibration intensity. A ratio of the first distance to the second distance may be equal to a ratio of the second vibration intensity to the first vibration intensity, and a ratio of the third distance to the second distance may be equal to a ratio of the second vibration intensity to the third vibration intensity.

For example, it may be assumed that the first distance 'c' between the stimulus point 611 and the sixth vibration device 516 is 6 cm, the second distance 'a' between the stimulus point 611 and the eighth vibration device 518 is 5 cm, and the third distance 'b' between the stimulus point 611 and the ninth vibration device 519 is 3 cm.

In this case, a ratio of the second distance 'a' to the first distance 'c' may be 5/6, and accordingly a ratio of vibration intensity of the sixth vibration device 516 to vibration intensity of an eighth vibration device 518 may be 5/6.

A ratio of the third distance 'b' to the first distance 'c' may be ½, and accordingly a ratio of vibration intensity of the sixth vibration device 516 to vibration intensity of a ninth vibration device 519 may be ½.

In this case, the processor may control the driver to make vibration intensity of the eighth vibration device 518 be 6/5 times vibration intensity of the sixth vibration device 516 and to make vibration intensity of the ninth vibration device 519 be twice vibration intensity of the sixth vibration device 516.

As different expression, the sum of vibration intensities of vibration devices for generating a stimulus at a stimulus point between a plurality of vibration devices may be 100%. In this case, the processor may output a sixth control signal, an eighth control signal, and a ninth control signal to make vibration intensity of the sixth vibration device 516 be 23.8%, to make vibration intensity of the eighth vibration device 518 be 28.6%, and to make vibration intensity of the ninth vibration device 519 be 47.6%.

The processor may change intensity of a vibration device or a vibrating vibration device to move the stimulus point.

This will be described with reference to FIG. 9.

Figure 9:
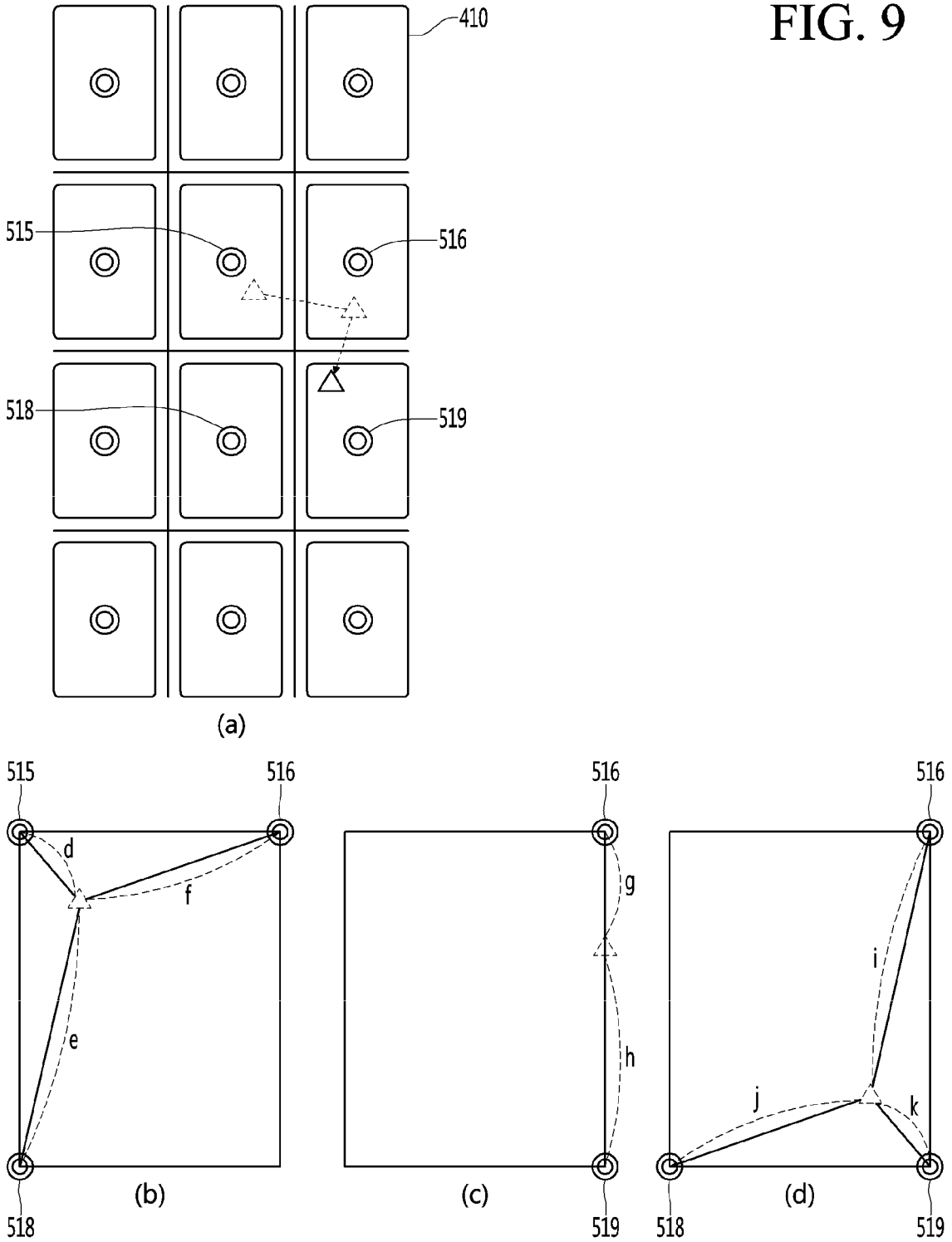
FIG. 9 is a diagram for explanation of a method of changing vibration intensity and a vibrating vibration device in order to change a stimulus point according to an embodiment of the present invention.

FIG. 9 is a diagram for explanation of a method of changing vibration intensity and a vibrating vibration device in order to change a stimulus point according to an embodiment of the present invention.

Referring to FIG. 9B, the processor 210 may determine a stimulus point. The processor 210 may select the four vibration devices 515, 516, 518, and 519 that form a figure for surrounding the stimulus point at the closest distance if being connected to each other, among the plurality of vibration devices 511, 512, 513, 514, 515, 516, 517, 518, 519, 520, 521, and 522.

The processor 210 may determine a fifth vibration device 515, the sixth vibration device 516, and the eighth vibration device 518, which are three vibration devices closest to the stimulus point 611 among the four vibration devices 515, 516, 518, and 519, as vibration devices adjacent to the stimulus point.

In this case, the processor 210 may determine vibration intensity of the vibration devices based on distances between the stimulus point and the vibration devices.

In detail, the processor may determine fifth vibration intensity of the fifth vibration device, sixth vibration intensity of the sixth vibration device, and eighth vibration intensity of the eighth vibration device based on a 'first distance 'd' between the stimulus point and the fifth vibration device 515', a 'second distance 'f' between the stimulus point and the sixth vibration device 516', and a 'third distance 'e' between the stimulus point and the eighth vibration device 518'.

In this case, a ratio of the second distance 'f' to the first distance may be equal to a ratio of the fifth vibration intensity to the sixth vibration intensity, and a ratio of the third distance 'e' to the first distance may be equal to a ratio of the fifth vibration intensity to the eighth vibration intensity.

The sum of the fifth vibration intensity of the fifth vibration device, the sixth vibration intensity of the sixth vibration device, and the eighth vibration intensity of the eighth vibration device may be 100%.

The processor may control the driver to change the stimulus point to a next point.

The changed stimulus point is shown in FIG. 9C.

The changed stimulus point may be positioned between the sixth vibration device 516 and the ninth vibration device 519.

Accordingly, the processor may control the driver to simultaneously vibrate the sixth vibration device 516 and the ninth vibration device 519, which are adjacent to the stimulus point, to generate a stimulus at a stimulus point between the sixth vibration device 516 and the ninth vibration device 519.

In this case, the processor may determine sixth vibration intensity of the sixth vibration device 516 and ninth vibration intensity of the ninth vibration device 519 based on a first distance 'g' between the stimulus point and the sixth vibration device 516 and a second distance 'h' between the stimulus point and the ninth vibration device 519.

In detail, a ratio of the second distance 'h' to the first distance 'g' may be equal to a ratio of the sixth vibration intensity to the ninth vibration intensity.

The sum of the sixth vibration intensity of the sixth vibration device 516 and the ninth vibration intensity of the ninth vibration device 519 may be 100%.

The processor may control the driver to change the stimulus point to a next point.

The changed stimulus point is shown in FIG. 9D.

Referring to FIG. 9D, the processor 210 may determine a stimulus point. The processor 210 may select the four vibration devices 515, 516, 518, and 519 that form a figure for surrounding the stimulus point at the closest distance if being connected to each other, among the plurality of vibration devices 511, 512, 513, 514, 515, 516, 517, 518, 519, 520, 521, and 522.

The processor 210 may determine the sixth vibration device 516, the eighth vibration device 518, and the ninth vibration device 519, which are three vibration devices closest to the stimulus point 611 among the four vibration devices 515, 516, 518, and 519, as vibration devices adjacent to the stimulus point.

In this case, the processor 210 may determine vibration intensity of the vibration devices based on distances between the stimulus point and the vibration devices.

In detail, the processor may determine sixth vibration intensity of the sixth vibration device, eighth vibration intensity of the eighth vibration device, and ninth vibration intensity of the ninth vibration device based on a 'first distance 'i' between the stimulus point and the sixth vibration device 516', a 'second distance 'j' between the stimulus point and the eighth vibration device 518', and a 'third distance 'k' between the stimulus point and the ninth vibration device 519'.

In this case, a ratio of the second distance 'j' to the first distance 'i' may be equal to a ratio of the sixth vibration intensity to the eighth vibration intensity, and a ratio of the third distance 'k' to the first distance 'i' may be equal to a ratio of the sixth vibration intensity to the ninth vibration intensity.

The sum of the sixth vibration intensity of the sixth vibration device, the eighth vibration intensity of the eighth vibration device, and the ninth vibration intensity of ninth vibration device may be 100%.

The processor may control the plurality of vibration devices to move the stimulus point in this manner.

For example, as shown in FIG. 9B, the processor may vibrate the fifth vibration device 515, the sixth vibration device 516, and the eighth vibration device 518 with vibration intensity based on a distance with a stimulus point to generate a stimulus at the stimulus point. Then, as shown in FIG. 9C, the processor may vibrate the sixth vibration device 516 and the ninth vibration device 519 with vibration intensity based on a distance with a stimulus point to generate a stimulus at the stimulus point. Then, as shown in FIG. 9D, the processor may vibrate the sixth vibration device 516, the eighth vibration device 518, and the ninth vibration device 519 with vibration intensity based on a distance with a stimulus point to generate a stimulus at the stimulus point.

The stimulus point may be the center point of a figure formed by connecting the fifth vibration device 515, the sixth vibration device 516, the eighth vibration device 518, and the ninth vibration device 519. In this case, the processor may vibrate the fifth vibration device 515, the sixth vibration device 516, the eighth vibration device 518, and the ninth vibration device 519 with the same vibration intensity to generate a stimulus at the stimulus point. In this case, the sum of vibration intensity of the fifth vibration device 515, vibration intensity of the sixth vibration device 516, vibration intensity of the eighth vibration device 518, and vibration intensity of the ninth vibration device 519 may be 100%.

As such, according to the present invention, a stimulus may be generated at a point between vibration devices, and thus a part that is desired to be massaged by a user may be advantageously and accurately stimulated.

According to the present invention, various stimulus points may be formed without movement of a stimulus device, and thus the overcome in terms of mechanical design limitations and an increase in manufacturing costs may be advantageously overcome.

In addition, according to the present invention, vibration intensity of a vibration device or a vibrating vibration device may be changed, and thus a point in which a stimulus is generated may be smoothly moved. For example, vibration intensity may be changed from a first vibration device of 100% and a second vibration device of 0% as a first stage to the first vibration device of 99% and the second vibration device of 1% as a second stage, and in this manner, vibration intensity may be gradually changed up to the first vibration device of 0% and the second vibration device of 100%, and thus the stimulus point may be very smoothly moved from the first vibration device to the second vibration device.

Figure 10:
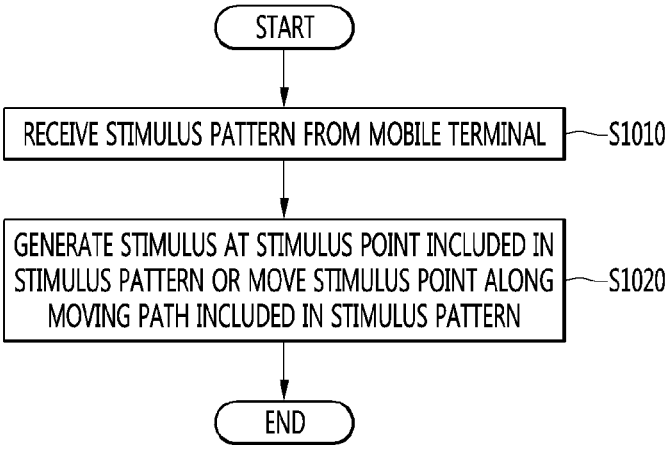
FIGS. 10 to 12 are diagrams for explanation of a method of receiving a stimulus pattern from a mobile terminal and generating a stimulus based on the received stimulus pattern according to an embodiment of the present invention.
Figure 11:
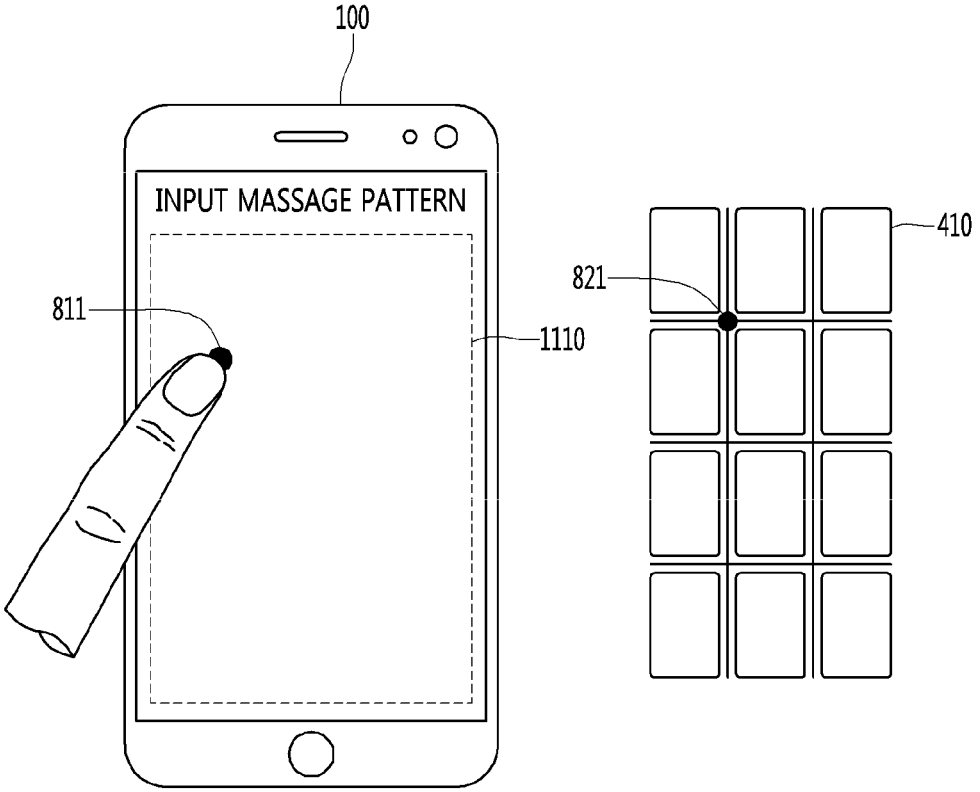
Figure 12:
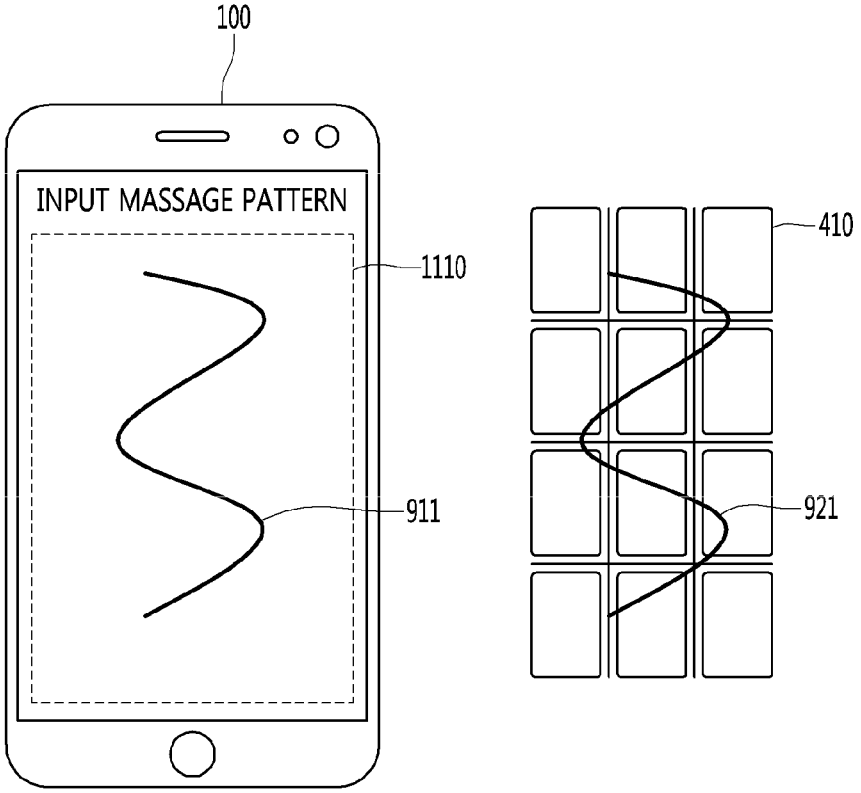

FIGS. 10 to 12 are diagrams for explanation of a method of receiving a stimulus pattern from a mobile terminal and generating a stimulus based on the received stimulus pattern according to an embodiment of the present invention.

Referring to FIG. 10, an operation method of a massage apparatus may include operation S1010 of receiving a stimulus pattern from a mobile terminal and operation S1020 of generating a stimulus at a stimulus point included in a stimulus pattern or moving the stimulus point along a moving path included in the stimulus pattern.

First, operation S1010 of receiving the stimulus pattern from the mobile terminal will be described.

When an application that interworks with a massage chair is executed, a processor of the mobile terminal 100 may display a window 1110 for receiving input of the massage pattern, as shown in FIG. 11.

Upon receiving touch input on the window 1110, the processor of the mobile terminal 100 may determine a massage pattern using the touch input received on the window 1110 and may transmit the massage pattern to the massage chair.

In this case, the processor of the massage chair may receive the massage pattern through a communication unit and may generate a stimulus based on the received massage pattern.

The stimulus pattern may include a stimulus point.

In detail, as shown in FIG. 11, the processor of the mobile terminal 100 may receive touch input of touching one point 811 of the window 1110. In this case, the processor of the mobile terminal 100 may transmit the stimulus pattern including information on the point 811 on which the touch input is received, to the massage chair.

In this case, the processor of the massage chair may receive the stimulus pattern and may control a driver to generate a stimulus at a stimulus point 821 corresponding to the point 811 on which the touch input is received.

In detail, upon receiving the stimulus pattern including the information on the point 811 on which the touch input is received, the processor of the massage chair may determine the point 821 corresponding to the point 811 on which the touch input is received, as a stimulus point, and may control the driver to generate a stimulus at the stimulus point 821.

Here, a position of the point 811 on the window 1110, on which the touch input is received, may correspond to a position of the stimulus point 821 on the vibration array 410.

The stimulus pattern may include a moving path of the stimulus point.

In detail, as shown in FIG. 12, the processor of the mobile terminal 100 may receive touch input that moves on the window 1110. In this case, the processor of the mobile terminal 100 may transmit a stimulus pattern including information on a path 911 along which the touch input moves, to the massage chair.

In this case, the processor of the massage chair may receive the stimulus pattern and may control the driver to move the stimulus point according to the moving path 911 of the touch input.

In detail, upon receiving the stimulus pattern including the information on the path 911 along which the touch input moves, the processor of the massage chair may move the stimulus point along a moving path 921 corresponding to the path 911 along which the touch input moves. In this case, the processor of the massage chair may control the driver to generate a stimulus while moving the stimulus point along the path 911 along which the touch input moves.

Here, a position of the path 911 along which the touch input moves on the window 1110 may correspond to a position of a moving path of a stimulus point 921 on the vibration array 410.

The stimulus pattern may include a moving path and moving speed of the stimulus point.

In detail, as shown in FIG. 12, the processor of the mobile terminal 100 may receive touch input that moves on the window 1110. In this case, the processor of the mobile terminal 100 may transmit a stimulus pattern including information on the path 911 along which the touch input moves and information on speed at which the touch input moves, to the massage chair.

In this case, the processor of the massage chair may receive and may move the stimulus point along the moving path corresponding to the path along which the touch input moves at moving speed corresponding to the speed at which the touch input moves.

In detail, the processor of the massage chair may move the stimulus point along the moving path 921 corresponding to the path 911 along which the touch input moves. In this case, the processor of the massage chair may move the stimulus point on the moving path 921 at moving speed corresponding to the speed at which the touch input moves.

According to an embodiment, it is assumed that touch input moves along the path 911 along which the touch input moves for 10 seconds. In this case, the processor of the massage chair may control the driver to move the stimulus point along the moving path 921 of the stimulus point for 50 seconds which is five times 10 seconds. In another example, it is assumed that touch input moves along the path 911 along which the touch input moves, for 5 seconds. In this case, the processor of the massage chair may control the driver to move the stimulus point along the moving path 921 of the stimulus point for 25 seconds which is five times 5 seconds.

In another example, it is assumed that touch input moves along the path 911 along which the touch input moves, for 10 seconds. In this case, the processor of the massage chair may control the driver to move the stimulus point along the moving path 921 of the stimulus point for 10 seconds (i.e., for the same time as a time period where touch input moves).

In another example, it is assumed that the touch input moves along the path 911 along which the touch input moves, for 5 seconds. In this case, the processor of the massage chair may control the driver to move the stimulus point along the moving path 921 of the stimulus point for 5 seconds.

In another example, it is assumed that the touch input moves on a first section of the moving path 911 for 3 seconds, moves on a second section of the moving path 911 for 2 seconds, and moves on a third section of the moving path 911 for 4 seconds.

In this case, the processor of the massage chair may control the driver to move the stimulus point on a period corresponding to the first section on the moving path 911 for 3 seconds, to move the stimulus point on a period corresponding to the second section for 2 seconds, and to move the stimulus point on a period corresponding to the third section for 4 seconds.

The processor may receive the stimulus pattern from the mobile terminal in real time and may generate a stimulus according to the stimulus pattern that is received in real time.

Here, real time may refer to a method of immediately performing required calculation and processing at a time point at which data is generated and transmitting the result to a point that requires the same.

In detail, upon receiving touch input, the processor of the mobile terminal may immediately process coordinates data of the touch input to generate a stimulus pattern including at least one of a point on which the touch input is received, a moving path of the touch input, or moving speed of the touch input, and may transmit the generated stimulus pattern to the massage chair.

Upon receiving the stimulus pattern, the processor of the massage chair may immediately process the stimulus pattern to generate a control signal based on the stimulus pattern, and may transmit the generated control signal to the driver.

Although the case in which the processor of the massage chair receives the stimulus pattern to generate a stimulus in real time has been described, the present invention is not limited thereto.

In detail, the massage chair may include a memory, and the memory may store a stimulus pattern that is generated by user input through the mobile terminal or an input unit of the massage chair or is generated by a manufacturer.

The processor of the massage chair may generate a stimulus corresponding to the stimulus pattern using the stimulus pattern stored in the memory.

As such, according to the present invention, a user may advantageously and accurately stimulate a part that is desired to be massaged by the user by simply touching a screen of the mobile terminal.

It may be advantageous that the user sets a moving path for smoothly moving a point, in which a stimulus is generated, using touch input through the window 1110 of the mobile terminal and that the massage chair smoothly moves the point in which the stimulus is generated according to path setting of the user.

According to the present invention, the user may also advantageously and simply set moving speed of the stimulus point by adjustment of drag speed.

The aforementioned present invention can also be embodied as computer readable code stored on a computer readable recording medium. The computer readable recording medium is any data storage device that can store data which can thereafter be read by a computer. Examples of the computer readable recording medium include a hard disk drive (HDD), a solid state drive (SSD), a silicon disk drive (SDD), read-only memory (ROM), random-access memory (RAM), CD-ROM, magnetic tapes, floppy disks, optical data storage devices, etc. The computer may include the processor 180 of the computer. Accordingly, it is intended that the present invention cover the modifications and variations of this invention provided they come within the scope of the appended claims and their equivalents.

The invention claimed is:

1. A massage apparatus comprising:

a vibration array including a plurality of vibration devices that are vertically and horizontally arranged;

a driver configured to vibrate the plurality of vibration devices; and a processor configured to:

control the driver to generate a stimulus at a stimulus point between the plurality of vibration devices by simultaneously vibrating two or more vibration devices among the plurality of vibration devices, select four vibration devices that are located closest to the stimulus point among the plurality of vibration devices and that define a rectangle surrounding the stimulus point, determine three vibration devices that are located closest to the stimulus point among the selected four vibration devices, wherein the determined three vibration devices include a first vibration device, a second vibration device, and a third vibration device, determine a first distance between the stimulus point and the first vibration device, a second distance between the stimulus point and the second vibration device, and a third distance between stimulus point and the third vibration device, based on the first distance, the second distance, and the third distance, determine a first vibration intensity of the first vibration device, a second vibration intensity of the second vibration device, and a third vibration intensity of the third vibration device, and control the driver to vibrate the determined three vibration devices among the selected four vibration devices, wherein a ratio of the first vibration intensity to the second vibration intensity is equal to a ratio of the second distance to the first distance, wherein a ratio of the first vibration intensity to the third vibration intensity is equal to a ratio of the third distance to the first distance, and wherein a ratio of the second vibration intensity to the third vibration intensity is equal to a ratio of the third distance to the second distance.

2. The massage apparatus of claim 1, wherein the processor is configured to change a vibration intensity of one of the two or more vibration devices or replace one of the two or more vibration devices with another of the plurality of vibration devices that is not included in the two or more vibration devices to thereby move the stimulus point.

3. The massage apparatus of claim 1, further comprising:

a communicator configured to receive a stimulus pattern from a mobile terminal, the stimulus pattern including:

path information about a path along which a touch input moves on the mobile terminal, speed information about a speed at which the touch input moves on the mobile terminal, and point information about a point at which the touch input is received on the mobile terminal, wherein the processor is configured to:

determine the stimulus point according to the point in the point information, and control the driver to move the stimulus point with a moving speed according to the speed in the speed information received from the mobile terminal along a moving path according to the path in the path information received from the mobile terminal.

4. The massage apparatus of claim 3, wherein the processor is configured to:

define the moving path along a plurality of positions between the plurality of vibration devices, and control the driver to move the stimulus point between the plurality of positions with the moving speed.

5. The massage apparatus of claim 3, wherein the processor is configured to:

determine a stimulus time based on a touch time for which the touch input moves along the path on the mobile terminal; and control the driver to move the stimulus point for the stimulus time with the moving speed along the moving path.

6. The massage apparatus of claim 5, wherein the stimulus time is determined by multiplying a coefficient and the touch time.

7. The massage apparatus of claim 6, wherein the coefficient is greater than or equal to 1.

8. The massage apparatus of claim 1, wherein the processor is configured to change a vibration intensity of one of the two or more vibration devices and replace one of the two or more vibration devices with another of the plurality of vibration devices that is not included in the two or more vibration devices to thereby move the stimulus point.

9. The massage apparatus of claim 1, wherein the processor is further configured to:

select two vibration devices that are located closest to the stimulus point among the plurality of vibration devices and that define a line passing through the stimulus point, and control the driver to vibrate the selected two vibration devices.

10. The massage apparatus of claim 9, wherein the selected two vibration devices include the first vibration device and the second vibration device, and wherein the processor is further configured to control the driver to simultaneously vibrate the first vibration device and the second vibration device with the first vibration intensity and the second vibration intensity, respectively.

11. The massage apparatus of claim 1, wherein the processor is further configured to control the driver to simultaneously vibrate the first vibration device, the second vibration device, and the third vibration device with the first vibration intensity, the second vibration intensity, and the third vibration intensity, respectively.

12. The massage apparatus of claim 1, wherein the processor is further configured to output (i) a first control signal having a first duty cycle corresponding to the first vibration intensity, (ii) a second control signal having a second duty cycle corresponding to the second vibration intensity, and (iii) a third control signal having a third duty cycle corresponding to the third vibration intensity.

* * * * *